US011702778B2

(12) United States Patent
Moody, III et al.

(10) Patent No.: US 11,702,778 B2
(45) Date of Patent: Jul. 18, 2023

(54) SELF-CRIMPED MULTI-COMPONENT FIBERS AND METHODS OF MAKING THE SAME

(71) Applicant: Berry Global, Inc., Evansville, IN (US)

(72) Inventors: Ralph A. Moody, III, Mooresville, NC (US); Mehmet Selcuk Sinangil, Mooresville, NC (US)

(73) Assignee: BERRY GLOBAL, INC., Evansville, IN (US)

( * ) Notice: Subject to any disclaimer, the term of this patent is extended or adjusted under 35 U.S.C. 154(b) by 641 days.

(21) Appl. No.: 16/585,833

(22) Filed: Sep. 27, 2019

(65) Prior Publication Data

US 2020/0102672 A1 Apr. 2, 2020

Related U.S. Application Data

(60) Provisional application No. 62/738,353, filed on Sep. 28, 2018.

(51) Int. Cl.

| | |
|---|---|
| ***D04H 3/007*** | (2012.01) |
| ***D04H 3/16*** | (2006.01) |
| ***D01D 5/22*** | (2006.01) |
| ***D01D 5/088*** | (2006.01) |
| ***D01D 7/00*** | (2006.01) |

(Continued)

(52) U.S. Cl.
CPC ..... *D04H 1/43828* (2020.05); *D01D 5/088* (2013.01); *D01D 5/22* (2013.01);
(Continued)

(58) Field of Classification Search
CPC ..... D04H 3/007; D04H 3/16; D04H 1/43828; D04H 1/43832; D04H 1/43835;
(Continued)

(56) References Cited

U.S. PATENT DOCUMENTS

| | | | |
|---|---|---|---|
| 6,454,989 | B1 | 9/2002 | Neely et al. |
| 2004/0013877 | A1 | 1/2004 | Nadkarni |

(Continued)

FOREIGN PATENT DOCUMENTS

| | | | |
|---|---|---|---|
| EP | 0277707 | A2 | 8/1988 |
| EP | 0685579 | A2 | 12/1995 |

(Continued)

OTHER PUBLICATIONS

English translation to WO 2009/027021 A2 obtained from European Patent Office website. (Year: 2009).*

(Continued)

*Primary Examiner* — Jeremy R Pierce

(74) *Attorney, Agent, or Firm* — Burr & Forman LLP

(57) ABSTRACT

Self-crimped multi-component fibers (SMF) are provided that include (i) a first component comprising a first polymeric material, in which the first polymeric material comprises a first melt flow rate (MFR) that is less than 50 g/10 min; and (ii) a second component comprising a second polymeric material, in which the second component is different than the first component. The SMF includes one or more three-dimensional crimped portions. Also provided are nonwoven fabrics comprising a plurality of SMFs. Methods of manufacturing SMFs and nonwoven fabrics including SMFs are also provided.

19 Claims, 13 Drawing Sheets

(51) Int. Cl.
*D04H 1/4382* (2012.01)
*D01F 8/06* (2006.01)
*D04H 1/4391* (2012.01)

(52) U.S. Cl.
CPC ..... *D01D 7/00* (2013.01); *D01F 8/06* (2013.01); *D04H 1/4383* (2020.05); *D04H 1/43832* (2020.05); *D04H 1/43835* (2020.05); *D04H 1/43914* (2020.05); *D04H 1/43918* (2020.05); *D04H 3/007* (2013.01); *D04H 3/16* (2013.01); *D10B 2321/021* (2013.01); *D10B 2321/022* (2013.01)

(58) Field of Classification Search
CPC ..... D04H 1/4383; D04H 1/43918; D04H 1/43914; D01D 5/22; D01D 5/088; D01D 7/00; D10B 2321/021; D10B 2321/022
See application file for complete search history.

(56) References Cited

U.S. PATENT DOCUMENTS

| | | | | |
|---|---|---|---|---|
| 2007/0014987 | A1 | 1/2007 | Usui et al. | |
| 2017/0335498 | A1* | 11/2017 | Hansen | D04H 3/16 |
| 2018/0002850 | A1* | 1/2018 | Hansen | D04H 3/147 |

FOREIGN PATENT DOCUMENTS

| | | | | |
|---|---|---|---|---|
| EP | 2343406 | A1 | 7/2011 | |
| EP | 3121314 | A1 | 1/2017 | |
| EP | 3246443 | A1 | 11/2017 | |
| EP | 3521495 | A1 | 8/2019 | |
| WO | 0028123 | A1 | 5/2000 | |
| WO | 0146506 | A2 | 6/2001 | |
| WO | 2005080497 | A1 | 9/2005 | |
| WO | WO-2009027021 | A2 * | 3/2009 | C08L 23/10 |
| WO | 2017198336 | A1 | 11/2017 | |

OTHER PUBLICATIONS

Second Written Opinion of international application PCT/US2019/053514 dated Sep. 8, 2020, all enclosed pages cited.
International Search Report and Written Opinion of international application PCT/US2019/053514 dated Dec. 20, 2019, all enclosed pages cited.
Office Action issued in corresponding Chinese Application No. 201980063539.2 dated Mar. 22, 2022, all enclosed pages cited.
Second Office Action issued in corresponding Chinese Application No. 201980063539.2 dated Nov. 14, 2022, all enclosed pages cited.

* cited by examiner

SELF-CRIMPED MULTI-COMPONENT FIBERS AND METHODS OF MAKING THE SAME

CROSS-REFERENCE TO RELATED APPLICATIONS

This application claims priority under 35 U.S.C. § 119(e) to U.S. Provisional Application No. 62/738,353, filed Sep. 28, 2018, which is expressly incorporated by reference herein in its entirety.

TECHNICAL FIELD

Embodiments of the presently-disclosed invention relate generally to self-crimped multi-component fibers (SMF) that include (i) a first component comprising a first polymeric material, in which the first polymeric material comprises a first melt flow rate (MFR) that is less than 50 g/10 min; and (ii) a second component comprising a second polymeric material, in which the second component is different than the first component. Embodiments of the presently-disclosed invention also relate to nonwoven fabrics comprising a plurality of SMFs. Embodiments of the presently-disclosed invention also relate to methods of forming SMFs and nonwoven fabrics including SMFs.

BACKGROUND

In nonwoven fabrics, the fibers forming the nonwoven fabric are generally oriented in the x-y plane of the web. As such, the resulting nonwoven fabric is relatively thin and lacking in loft or significant thickness in the z-direction. Loft or thickness in a nonwoven fabric suitable for use in hygiene-related articles (e.g., personal care absorbent articles) promotes comfort (softness) to the user, surge management, and fluid distribution to adjacent components of the article. In this regard, high loft, low density nonwoven fabrics are used for a variety of end-use applications, such as in hygiene-related products (e.g., sanitary pads and napkins, disposable diapers, incontinent-care pads, etc.). High loft and low density nonwoven fabrics, for instance, may be used in products such as towels, industrial wipers, incontinence products, infant care products (e.g., diapers), absorbent feminine care products, and professional health care articles In order to impart loft or thickness to a nonwoven fabric, it is generally desirable that at least a portion of the fibers comprising the web be oriented in the z-direction. Conventionally, such lofty nonwoven webs are produced using crimped staple fibers or post-forming processes, such as creping/pleating of the formed fabric or a post fiber-formation heating step to induce or activate a latent crimp to produce crimped fibers. The use of a subsequent heating step to activate latent crimp and produce crimped fibers, however, can be disadvantageous in several respects. Utilization of heat, such as hot air, requires continued heating of a fluid medium and therefore increases capital and overall production costs. In addition, variations in process conditions and equipment associated with high temperature processes can also cause variations in loft, basis weight and overall uniformity.

Therefore, there remains a need in the art for self-crimped multi-component fibers (SMF) and nonwoven fabrics including such SMFs, for example, that may have certain desirable physical attributes or properties such as softness, resiliency, strength, high porosity and overall uniformity.

There also remains a need in the art for methods of forming such SMFs and nonwoven fabrics including such SMFs, for example, without the need for a subsequent heating and/or stretching step to form crimps and/or loftiness.

SUMMARY

One or more embodiments of the invention may address one or more of the aforementioned problems. Certain embodiments according to the invention provide self-crimped multi-component fibers (SMF) including (i) a first component comprising a first polymeric material, in which the first polymeric material comprises a first melt flow rate (MFR) that is less than 50 g/10 min; and (ii) a second component comprising a second polymeric material, in which the second component is different than the first component. In accordance with certain embodiments of the invention, the SMF may comprise one or more crimped portions (e.g., three-dimensional crimped portions). In accordance with certain embodiments of the invention, the second polymeric material may optionally comprise a second MFR less than 50 g/10 min.

In another aspect, the present invention provides a nonwoven fabric comprising a cross-direction, a machine direction, and a z-direction thickness. In accordance with certain embodiments of the invention, the nonwoven fabric may comprise a plurality of SMFs as described and disclosed herein. In accordance with certain embodiments of the invention, the nonwoven fabric may comprise or be implanted within a hygiene-related article (e.g., diaper), in which one or more of the components of the hygiene-related article comprises a nonwoven fabric as described and disclosed herein.

In another aspect, the present invention provides a method of forming a plurality of self-crimped multi-component fibers (SMF). In accordance with certain embodiments of the invention, the method may comprise separately melting at least a first polymeric material to provide a first molten polymeric material and a second polymeric material to provide a second molten polymeric material, in which the first polymeric material comprises a first melt flow rate (MFR) that is less than 50 g/10 min. The method may further comprise separately directing the first molten polymeric material and the second molten polymeric material through a spin beam assembly equipped with a distribution plate configured such that the separate first molten polymeric material and the second molten polymeric material combine at a plurality of spinnerette orifices to form molten multi-component filaments containing both the first molten polymeric material and the second molten polymeric material. The method may further comprise extruding the molten multi-component filaments from the spinnerette orifices into a quench chamber and directing quench air from at least a first independently controllable blower into the quench chamber and into contact with the molten multi-component filaments to cool and at least partially solidify the multi-component filaments to provide at least partially solidified multi-component filaments. The method may further comprise directing the at least partially solidified multi-component filaments and optionally the quench air into and through a filament attenuator and pneumatically attenuating and stretching the at least partially solidified multi-component filaments. The method may further comprise directing the at least partially solidified multi-component filaments from the attenuator into a filament diffuser unit and allowing the at least partially solidified multi-component filaments to form the one or more three-dimensional crimped portions to provide the plurality of SMFs as described and disclosed herein. In accordance with certain embodiments of the invention, the method may further comprise directing the plurality of SMFs through the filament diffuser unit and depositing the plurality of SMFs randomly upon a moving continuous air-permeable belt.

In yet another aspect the present invention provides a method of forming a nonwoven fabric as disclosed and described herein. In accordance with certain embodiments of the invention, for instance, the method may comprise forming or providing a first disposable-high-loft ("DHL") nonwoven web (e.g., unconsolidated) comprising a first plurality of randomly deposited SMFs and consolidating the first DHL nonwoven web to provide a first DHL nonwoven layer.

BRIEF DESCRIPTION OF THE DRAWING(S)

The invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout, and wherein.

DETAILED DESCRIPTION

Figure 1:
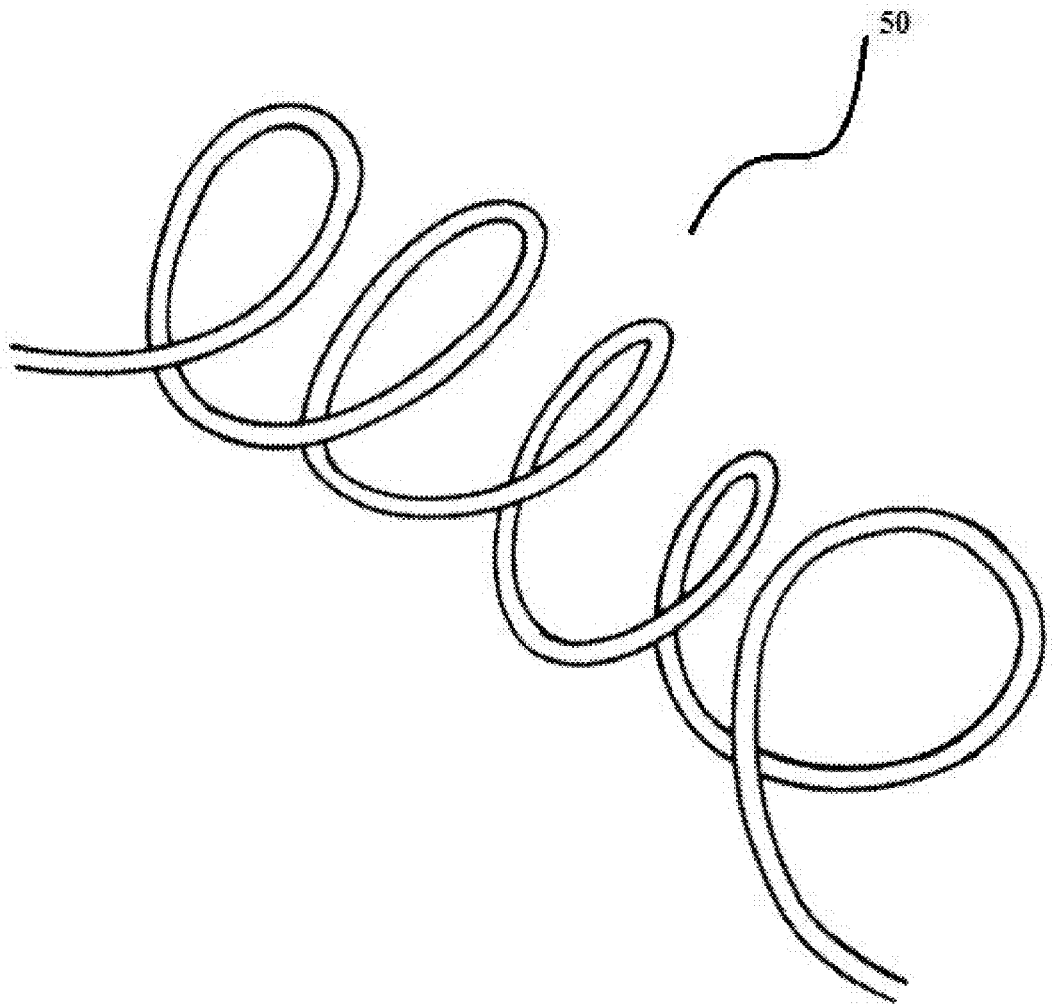
FIG. 1 illustrates a self-crimped multi-component fiber (e.g., continuous fiber) in accordance with certain embodiments of the invention.

The invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. As used in the specification, and in the appended claims, the singular forms "a", "an", "the", include plural referents unless the context clearly dictates otherwise.

The presently-disclosed invention relates generally to self-crimped multi-component fibers (SMF) that include (i) a first component comprising a first polymeric material, in which the first polymeric material comprises a first melt flow rate (MFR) that is less than 50 g/10 min; and (ii) a second component comprising a second polymeric material, in which the second component is different than the first component. In accordance with certain embodiments of the invention, the SMFs may have particularly desirable physical attributes or properties such as softness, resiliency, strength, high porosity and overall uniformity. In this regard, SMFs and nonwoven layers or fabrics formed therefrom may provide higher loft and/or softness that may be desired in a variety of hygiene-related applications (e.g., diapers). The SMFs as described and disclosed herein, in accordance with certain embodiments of the invention, include one or more crimped portions (e.g., coiled or helical crimped portions) that may impart a loftiness to the material. In accordance with certain embodiments of the invention, the self-crimping nature of the SMFs beneficially may be devoid of after-treatments fatigue (e.g., broken fibers) and/or distortions associated with crimped fibers obtained via post-formation crimp imparting processes. In this regard, the presently-disclosed invention also provides methods of forming such SMFs and nonwoven fabrics including such SMFs, for example, without the need for a subsequent heating and/or stretching step to form crimps and/or loftiness. For example, the methods of forming the SMFs and/or a nonwoven fabric comprising such SMFs may be devoid of any post-fiber forming crimp imparting operations (e.g., mechanical or thermal crimping operations during or after laydown of the fibers).

The terms "substantial" or "substantially" may encompass the whole amount as specified, according to certain embodiments of the invention, or largely but not the whole amount specified (e.g., 95%, 96%, 97%, 98%, or 99% of the whole amount specified) according to other embodiments of the invention.

The terms "polymer" or "polymeric", as used interchangeably herein, may comprise homopolymers, copolymers, such as, for example, block, graft, random, and alternating copolymers, terpolymers, etc., and blends and modifications thereof. Furthermore, unless otherwise specifically limited, the term "polymer" or "polymeric" shall include all possible structural isomers; stereoisomers including, without limitation, geometric isomers, optical isomers or enantionmers; and/or any chiral molecular configuration of such polymer or polymeric material. These configurations include, but are not limited to, isotactic, syndiotactic, and atactic configurations of such polymer or polymeric material. The term "polymer" or "polymeric" shall also include polymers made from various catalyst systems including, without limitation, the Ziegler-Natta catalyst system and the metallocene/single-site catalyst system. The term "polymer" or "polymeric" shall also include, in according to certain embodiments of the invention, polymers produced by fermentation process or biosourced.

The term "cellulosic fiber", as used herein, may comprise fibers derived from hardwood trees, softwood trees, or a combination of hardwood and softwood trees prepared for use in, for example, a papermaking furnish and/or fluff pulp furnish by any known suitable digestion, refining, and bleaching operations. The cellulosic fibers may comprise recycled fibers and/or virgin fibers. Recycled fibers differ from virgin fibers in that the fibers have gone through the drying process at least once. In certain embodiments, at least a portion of the cellulosic fibers may be provided from non-woody herbaceous plants including, but not limited to, kenaf, cotton, hemp, jute, flax, sisal, or abaca. Cellulosic fibers may, in certain embodiments of the invention, comprise either bleached or unbleached pulp fiber such as high yield pulps and/or mechanical pulps such as thermo-mechanical pulping (TMP), chemical-mechanical pulp (CMP), and bleached chemical-thermo-mechanical pulp BCTMP. In this regard, the term "pulp", as used herein, may comprise cellulose that has been subjected to processing treatments, such as thermal, chemical, and/or mechanical treatments. Cellulosic fibers, according to certain embodiments of the invention, may comprise one or more pulp materials.

The terms "nonwoven" and "nonwoven web", as used herein, may comprise a web having a structure of individual fibers, filaments, and/or threads that are interlaid but not in an identifiable repeating manner as in a knitted or woven fabric. Nonwoven fabrics or webs, according to certain embodiments of the invention, may be formed by any process conventionally known in the art such as, for example, meltblowing processes, spunbonding processes, needle-punching, hydroentangling, air-laid, and bonded carded web processes.

The term "staple fiber", as used herein, may comprise a cut fiber from a filament. In accordance with certain embodiments, any type of filament material may be used to form staple fibers. For example, staple fibers may be formed from polymeric fibers, and/or elastomeric fibers. Non-limiting examples of materials may comprise polyolefins (e.g., a polypropylene or polypropylene-containing copolymer), polyethylene terephthalate, and polyamides. The average length of staple fibers may comprise, by way of example only, from about 2 centimeter to about 15 centimeter.

The term "layer", as used herein, may comprise a generally recognizable combination of similar material types and/or functions existing in the X-Y plane.

The term "multi-component fibers", as used herein, may comprise fibers formed from at least two different polymeric materials or compositions (e.g., two or more) extruded from separate extruders but spun together to form one fiber. The term "bi-component fibers", as used herein, may comprise fibers formed from two different polymeric materials or compositions extruded from separate extruders but spun together to form one fiber. The polymeric materials or polymers are arranged in a substantially constant position in distinct zones across the cross-section of the multi-component fibers and extend continuously along the length of the multi-component fibers. The configuration of such a multi-component fibers may be, for example, a sheath/core arrangement wherein one polymer is surrounded by another, an eccentric sheath/core arrangement, a side-by-side arrangement, a pie arrangement, or an "islands-in-the-sea" arrangement, each as is known in the art of multicomponent, including bicomponent, fibers.

The term "machine direction" or "MD", as used herein, comprises the direction in which the fabric produced or conveyed. The term "cross-direction" or "CD", as used herein, comprises the direction of the fabric substantially perpendicular to the MD.

The term "crimp" or "crimped", as used herein, comprises a three-dimensional curl or bend such as, for example, a folded or compressed portion having an "L" configuration, a wave portion having a "zig-zag" configuration, or a curl portion such as a helical configuration. In accordance with certain embodiments of the invention, the term "crimp" or "crimped" does not include random two-dimensional waves or undulations in a fiber, such as those associated with normal lay-down of fibers in a melt-spinning process.

The term "disposable-high-loft" and "DHL", as used herein, comprises a material that comprises a z-direction thickness generally in excess of about 0.3 mm and a relatively low bulk density. The thickness of a "disposable-high-loft" nonwoven and/or layer may be greater than 0.3 mm (e.g., greater than 0.4 mm. greater than 0.5 mm, or greater than 1 mm) as determined utilizing a ProGage Thickness tester (model 89-2009) available from Thwig-Albert Instrument Co. (West Berlin, N.J. 08091), which utilizes a 2" diameter foot, having a force application of 1.45 kPa during measurement. In accordance with certain embodiments of the invention, the thickness of a "disposable-high-loft" nonwoven and/or layer may be at most about any of the following: 3, 2.75, 2.5, 2.25, 2, 1.75, 1.5, 1.25, 1.0, 0.75, and 0.5 mm and/or at least about any of the following: 0.3, 0.4, 0.5, 0.75, 1.0, 1.25, 1.5, 1.75, and 2.0 mm. "Disposable-high-loft" nonwovens and/or layers, as used herein, may additionally have a relatively low density (e.g., bulk density—weight per unit volume), such as less than about 60 $kg/m^3$, such as at most about any of the following: 70, 60, 55, 50, 45, 40, 35, 30, and 25 $kg/m^3$ and/or at least about any of the following: 10, 15, 20, 25, 30, 35, 40, 45, 50, and 55 $kg/m^3$.

The term "polydispersity", as used herein, comprises the ratio of a polymeric material's mass weighted molecular weight ($M_w$) to the number weighted molecular weight ($M_n$)–$M_w/M_n$.

Whenever a melt flow rate (MFR) is referenced herein, the value of the MFR is determined in accordance with standard procedure ASTM D1238 (2.16 kg at 230° C.).

All whole number end points disclosed herein that can create a smaller range within a given range disclosed herein are within the scope of certain embodiments of the invention. By way of example, a disclosure of from about 10 to about 15 includes the disclosure of intermediate ranges, for example, of: from about 10 to about 11; from about 10 to about 12; from about 13 to about 15; from about 14 to about 15; etc. Moreover, all single decimal (e.g., numbers reported to the nearest tenth) end points that can create a smaller range within a given range disclosed herein are within the scope of certain embodiments of the invention. By way of example, a disclosure of from about 1.5 to about 2.0 includes the disclosure of intermediate ranges, for example, of: from about 1.5 to about 1.6; from about 1.5 to about 1.7; from about 1.7 to about 1.8; etc.

In one aspect, the invention provides self-crimped multi-component fibers (SMF) including (i) a first component comprising a first polymeric material, in which the first polymeric material comprises a first melt flow rate (MFR) that is less than 50 g/10 min; and (ii) a second component comprising a second polymeric material, in which the second component is different than the first component. In accordance with certain embodiments of the invention, the second polymeric material may comprise a second MFR less than 50 g/10 min. In accordance with certain embodiments of the invention, the SMF may comprise one or more crimped portions (e.g., three-dimensional crimped portions). FIG. 1, for instance, illustrates a continuous SMF 50 in accordance with certain embodiments of the invention, in which the SMF 50 includes plurality of three-dimensional coiled or helically shaped crimped portions. Although FIG. 1 illustrates a continuous SMF, a SMF in accordance with certain embodiments of the invention may comprise a staple fiber, a discontinuous meltblown fiber, or a continuous fiber (e.g., spunbond or meltblown).

In accordance with certain embodiments of the invention, the SMFs may comprise an average free crimp percentage from about 50% to about 300%, such as at most about any of the following: 300, 275, 250, 225, 200, 175, 150, 125, 100, and 75% and/or at least about any of the following: 50, 75, 100, 125, 150, 175, and 200%. The SMFs, in accordance with certain embodiments of the invention, may include a plurality of discrete zig-zag configured crimped portions, a plurality of discrete or continuously coiled or helically configured crimped portions, or a combination thereof. The average free crimp percentage may be ascertained by determining the free crimp length of the fibers in question with an Instron 5565 equipped with a 2.5N load cell. In this regard, free or unstretched fiber bundles may be placed into clamps of the machine. The free crimp length can be measured at the point where the load (e.g., 2.5 N load cell) on the fiber bundle becomes constant. The following parameters are used to determine the free crimp length: (i) Record the Approximate free fibers bundle weight in grams (e.g., xxx g±0.002 grams); (ii) Record the Unstretched bundle length in inches; (iii) Set the Gauge Length (i.e., the distance or gap between the clamps holding the bundle of fibers) of the Inston to 1 inch; and (iv) Set the Crosshead Speed to 2.4 inches/minute. The free crimp length of the fibers in question may then be ascertained by recording the extension length of the fibers at the point where the load becomes constant (i.e., the fibers are fully extended). The average free crimp percentage may be calculated from the free crimp length of the fibers in question and the unstretched fiber bundles length (e.g., the gauge length). For example, a measured free crimp length of 32 mm when using a 1 inch (25.4 mm) gauge length as discussed above would provide an average free crimp percentage of about 126%. The foregoing method to determining the average free crimp percentage may be particularly beneficial when evaluating continuous fibers having helically coiled crimps. For instance, traditional textile fibers are mechanically crimped and can be measured optically but continuous fibers having helically coiled crimped portions cause errors in trying to optically count "crimp" in such fibers.

In accordance with certain embodiments of the invention, the SMFs may comprise a plurality of three-dimensional crimped portions having an average diameter (e.g., based on the average of the longest length defining an individual crimped portion) from about 0.5 mm to about 5 mm, such as at most about any of the following: 5, 4.75, 4.5, 4.25, 4, 3.75, 3.5, 3.25, 3, 2.9, 2.8, 2.7, 2.6, 2.5, 2.4, 2.3, 2.2, 2.1, 2, 1.9, 1.8, 1.7, 1.6, and 1.5 mm and/or at least about any of the following: 0.5, 0.6, .07, 0.8, 0.9, 1, 1.1, 1.2, 1.3, 1.4, 1.5, 1.6, 1.7, 1.8, 1.9, and 2 mm. In accordance with certain embodiments of the invention, the average diameter of the plurality of three-dimensional crimped portions can be ascertained by use of a digital optical microscope (Manufactured by HiRox in Japan KH-7700) to view SMF samples and obtain digital measurement of loop diameters of the three-dimensional crimped portions of the SMFs. Magnification ranges generally in the 20× to 40× can be used to ease evaluation of the loop diameter formed from the three-dimensional crimping of the SMFs.

The SMFs may comprise a variety of cross-sectional geometries and/or deniers, such as round or non-round cross-sectional geometries. In accordance with certain embodiments of the invention, a plurality of SMFs may comprise all or substantially all of the same cross-sectional geometry or a mixture of differing cross-sectional geometries to tune or control various physical properties. In this regard, a plurality of SMFs may comprise a round cross-section, a non-round cross-section, or combinations thereof. In accordance with certain embodiments of the invention, for example, a plurality of SMFs may comprise from about 10% to about 100% of round cross-sectional fibers, such as at most about any of the following: 100, 95, 90, 85, 75, and 50% and/or at least about any of the following: 10, 20, 25, 35, 50, and 75%. Additionally or alternatively, a plurality of SMFs from about 10% to about 100% of non-round cross-sectional fibers, such as at most about any of the following: 100, 95, 90, 85, 75, and 50% and/or at least about any of the following: 10, 20, 25, 35, 50, and 75%. In accordance with embodiments of the invention including non-round cross-sectional SMFs, these non-round cross-sectional SMFs may comprise an aspect ratio of greater than 1.5:1, such as at most about any of the following: 10:1, 9:1, 8:1, 7:1, 6:1, 5:1, 4:1, 3:1, and 2:1 and/or at least about any of the following: 1.5:1, 2:1, 2.5:1, 3:1, 4:1, 5:1, and 6:1. In accordance with certain embodiments of the invention, a plurality of SMFs may be admixed or blended with non-crimped fibers (e.g., mono-component and/or multi-component fibers).

In accordance with certain embodiments of the invention, a SMF may comprise a sheath/core configuration, a side-by-side configuration, a pie configuration, an islands-in-the-sea configuration, a multi-lobed configuration, or any combinations thereof. In accordance with certain embodiments of the invention, the sheath/core configuration may comprise an eccentric sheath/core configuration (e.g., bi-component fiber) including a sheath components and core component that is not concentrically located within the sheath component. The core component, for example, may define at least a portion of an outer surface of the SMF having the eccentric sheath/core configuration in accordance with certain embodiments of the invention.

Figure 2A:
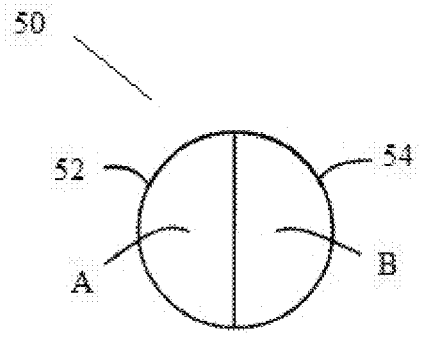
FIG. 2A-2H illustrate examples of cross-sectional views for some example multi-component fibers in accordance with certain embodiments of the invention.
Figure 2B:
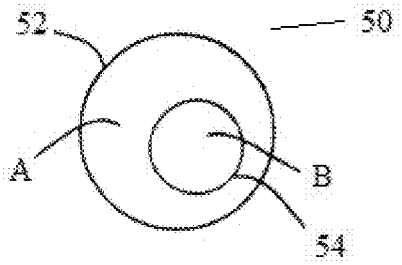
Figure 2C:
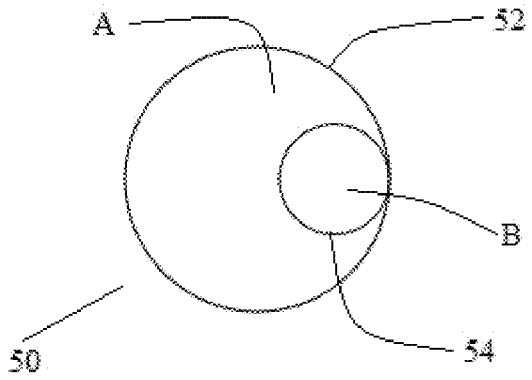
Figure 2D:
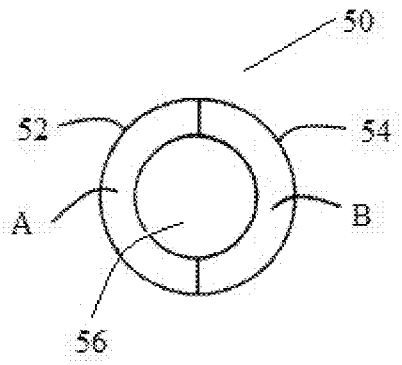
Figure 2E:
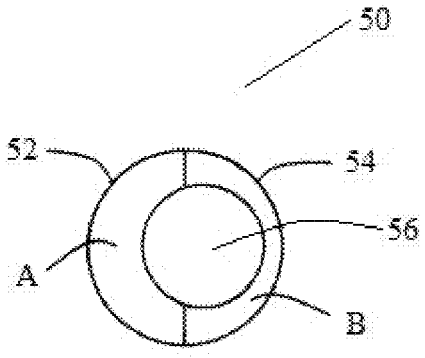
Figure 2F:
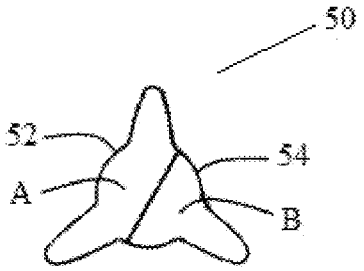
Figure 2G:
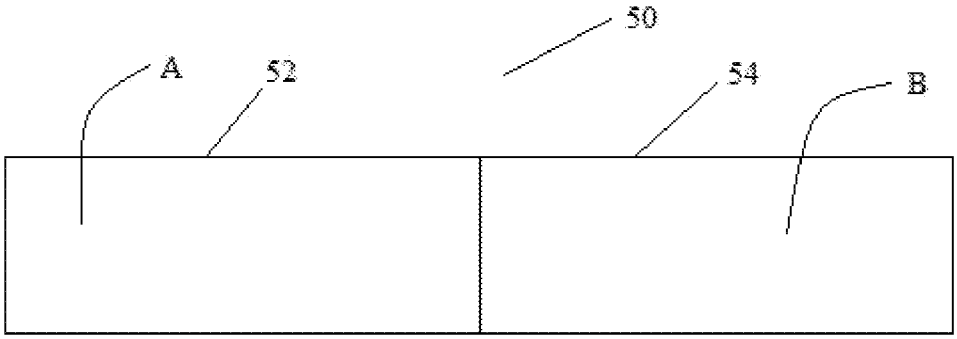
Figure 2H:
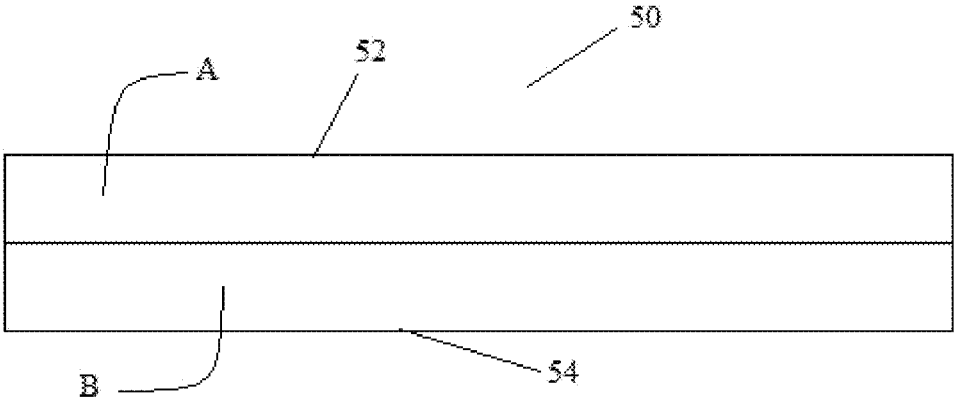

FIGS. 2A-2H illustrate examples of cross-sectional views for some non-limiting examples of SMFs in accordance with certain embodiments of the invention. As illustrated in FIG. 2A-2H, the SMF 50 may comprise a first polymeric component 52 of a first polymeric composition A and a second polymeric component 54 of a second polymeric composition B. The first and second components 52 and 54 can be arranged in substantially distinct zones within the cross-section of the SMF that extend substantially continuously along the length of the SMF. The first and second components 52 and 54 can be arranged in a side-by-side arrangement in a round cross-sectional fiber as depicted in FIG. 2A or in a ribbon-shaped (e.g., non-round) cross-sectional fiber as depicted in FIGS. 2G and 2H. Additionally or alternatively, the first and second components 52 and 54 can be arranged in a sheath/core arrangement, such as an eccentric sheath/core arrangement as depicted in FIGS. 2B and 2C. In the eccentric sheath/core SMFs as illustrated in FIG. 2B, one component fully occludes or surrounds the other but is asymmetrically located in the SMF to allow fiber crimp (e.g., first component 52 surrounds component 54). Eccentric sheath/core configurations as illustrated by FIG. 2C include the first component 52 (e.g., the sheath component)

substantially surrounding the second component 54 (e.g., the core component) but not completely as a portion of the second component may be exposed and form part of the outermost surface of the fiber 50. As additional examples, the SMFs can comprise hollow fibers as shown in FIGS. 2D and 2E or as multilobal fibers as shown in FIG. 2F. It should be noted, however, that numerous other cross-sectional configurations and/or fiber shapes may be suitable in accordance with certain embodiments of the invention. In the multi-component fibers, in accordance with certain embodiments of the invention, the respective polymer components can be present in ratios (by volume or my mass) of from about 85:15 to about 15:85. Ratios of approximately 50:50 (by volume or mass) may be desirable in accordance with certain embodiments of the invention; however, the particular ratios employed can vary as desired, such as at most about any of the following: 85:15, 80:20, 75:25, 70:30, 65:35, 60:40, 55:45 and 50:50 by volume or mass and/or at least about any of the following: 50:50, 45:55, 40:60, 35:65, 30:70, 25:75, 20:80, and 15:85 by volume or mass.

As noted above, the SMFs may comprise a first component comprising a first polymeric composition and a second component comprising a second polymeric composition, in which the first polymeric composition is different than the second polymeric composition. For example, the first polymeric composition may comprise a first polyolefin composition and the second polymeric composition may comprise a second polyolefin composition. In accordance with certain embodiments of the invention, the first polyolefin composition may comprise a first polypropylene or blend of polypropylenes and the second polyolefin composition may comprise a second polypropylene and/or a second polyethylene, in which the first polypropylene or blend of polypropylenes has, for example, a melt flow rate that is less than 50 g/10 min. Additionally or alternatively, the first polypropylene or blend of polypropylenes may have a lower degree of crystallinity than the second polypropylene and/or a second polyethylene.

In accordance with certain embodiments of the invention, the first polymeric composition and the second polymeric composition can be selected so that the multi-component fibers develop one or more crimps therein without additional application of heat either in the diffuser section just after the draw unit but before laydown, once the draw force is relaxed, and/or post-treatments such as after fiber lay down and web formation. The polymeric compositions, therefore, may comprise polymers that are different from one another in that they have disparate stress or elastic recovery properties, crystallization rates, and/or melt viscosities. In accordance with certain embodiments of the invention, the polymeric compositions may be selected to self-crimp by virtue of the melt flow rates of the first and second polymeric compositions as described and disclosed herein. In accordance with certain embodiments of the invention, multi-component fibers, for example, can form or have crimped fiber portions having a helically-shaped crimp in a single continuous direction. For example, one polymeric composition may be substantially and continuously located on the inside of the helix formed by the crimped nature of the fiber.

In accordance with certain embodiments of the invention, for example, the first polymeric composition of the first component may comprise a first MFR from about 20 g/10 min to about 50 g/10 min, such as at most about any of the following: 50, 49, 48, 46, 44, 42, 40, 38, 36, 35, 34, 32, and 30 g/10 min and/or at least about any of the following: 20, 22, 24, 25, 26, 28, 30, 32, 34, and 35 g/10 min. In accordance with certain embodiments of the invention, the second polymeric composition of the second component may comprise a second MFR from about 20 g/10 min to about 48 g/10 min, such as at most about any of the following: 48, 46, 44, 42, 40, 38, 36, 35, 34, 32, and 30 g/10 min and/or at least about any of the following: 20, 22, 24, 25, 26, 28, 30, 32, 34, and 35 g/10 min. In accordance with certain embodiments of the invention, the difference in the MFR between the first polymeric composition and the second polymeric composition may comprise from about 8 g/10 min to about 30 g/10 min, such as at most about any of the following: 30, 28, 26, 25, 24, 22, 20, 18, 16, 15, 14, 12, 10, and 8 g/10 min and/or at least about any of the following: 8, 10, 12, 14, and 15 g/10 min.

As noted above, the first polyolefin composition may comprise a blend of polyolefin fractions or components (e.g., polypropylene fraction A and a different polypropylene fraction B that are mixed to provide a polypropylene blend). For example, the first polyolefin composition may comprise a blend of a polyolefin fraction A and a polyolefin fraction B, wherein the polyolefin fraction A accounts for more than 50% by weight of the first polyolefin composition and has a polyolefin fraction A-MFR (e.g., a low MFR relative to that of polyolefin fraction B) being less than a polyolefin fraction B-MFR of the polyolefin fraction B. In accordance with certain embodiments of the invention, for instance, the first polyolefin composition has a MFR-Ratio between the polyolefin fraction B-MFR (e.g., the higher MFR material of the two) and the polyolefin fraction A-MFR (e.g., the lower MFR material of the two) from about 15:1 to about 100:1, such as at most about any of the following: 100:1, 90:1, 80:1, 75:1, 70:1, 65:1, 60:1, 55:1, 50:1, 45:1, and 40:1 and/or at least about any of the following: 15:1, 18:1, 20:1, 22:1, 24:1, 25:1, 26:1, 28:1, 30:1, 32:1, 34:1, 35:1, and 40:1. In accordance with certain embodiments of the invention, the polyolefin fraction B (e.g., the higher MFR material of the two) comprises from about 0.5% by weight to about 20% by weight of the first polyolefin composition, such as at most about any of the following: 20, 18, 16, 15, 14, 12, 10, 8, and 6% by weight of the first polyolefin composition and/or at least about any of the following: 0.5, .075, 1, 2, 3, 4, 5, 6, 7, 8, 9, and 10% by weight of the first polyolefin composition. By way of example, certain embodiments in accordance with the invention may comprise SMFs in which the first component and the second are formed from the same base polymeric material (e.g., same polypropylene—low MFR polypropylene as disclosed herein) with the only difference being the addition of a high MFR polymer (e.g., high MFR polypropylene as disclosed herein) to the first component such that the MFR of the first component is larger than the MFR of the second component. In this regard, the high MFR polymer (e.g., high MFR polypropylene as disclosed herein) may comprise the polyolefin fraction B and the base layer having the notably lower MFR may comprise polyolefin fraction A. In accordance with such embodiments of the invention, for instance, the first component may be formed from the blend of polyolefin fraction A and polyolefin fraction B, while the second component may be formed from polyolefin fraction B. In accordance with certain embodiments of the invention, the only difference between the first component and the second component may be the addition of the polyolefin fraction B to the first component. In accordance with certain additional embodiments of the invention, the first component may be formed from the blend of polyolefin fraction A and polyolefin fraction B while the second component may be formed from a polyethylene in "neat" or unmodified form.

Additionally or alternatively, SMFs, in accordance with certain embodiments of the invention, may comprise a mass or volume ratio between the first component and the second component ranging from about 85:15 to about 15:85 (by volume or mass), such as at most about any of the following: 85:15, 80:20, 75:25, 70:30, 65:35, 60:40, 55:45 and 50:50 by volume or mass and/or at least about any of the following: 50:50, 45:55, 40:60, 35:65, 30:70, 25:75, 20:80, and 15:85 by volume or mass.

In accordance with certain embodiments of the invention, the first polyolefin composition (e.g., having a MFR below 50 g/10 min) has a polydispersity value from about 3 to about 10, such as at most about any of the following: 10, 9.5, 9, 8.5, 8, 7.5, 7, 6.5, 6, 5.5, 5, and 4.5 and/or at least about any of the following: 3, 3.5, 4, 4.5, 5, and 5.5. In accordance with certain embodiments of the invention, the first polyolefin composition comprises a blend (e.g., a blend of two or more polyolefins, such as two or more polypropylenes) including polyolefin fraction A (e.g., the lower MFR material of the two as discussed above) that has a polyolefin fraction A-polydispersity value from about 3 to about 10, such as at most about any of the following: 10, 9.5, 9, 8.5, 8, 7.5, 7, 6.5, 6, 5.5, 5, and 4.5 and/or at least about any of the following: 3, 3.5, 4, 4.5, 5, and 5.5. In accordance with certain embodiments of the invention, both the first component and the second component comprise a polydispersity value from 3 to 10 (or any of the intermediate values and/or ranges noted above).

SMFs, in accordance with certain embodiments of the invention, may comprise, for example, a side-by-side configuration having a round cross-section, and wherein polyolefin fraction A and a polyolefin fraction B both comprise a polypropylene and the second polyolefin composition comprises a second polypropylene and/or a second polyethylene.

In another aspect, the present invention provides a nonwoven fabric comprising a cross-direction, a machine direction, and a z-direction thickness. In accordance with certain embodiments of the invention, the nonwoven fabric may comprise a plurality of SMFs as described and disclosed herein. In accordance with certain embodiments of the invention, the nonwoven fabric may comprise or be implanted within a hygiene-related article (e.g., diaper), in which one or more of the components of the hygiene-related article comprises a nonwoven fabric as described and disclosed herein. In accordance with certain embodiments of the invention the nonwoven fabric may comprise a first disposable-high-loft ("DHL") nonwoven layer alone or in combination with one or more nonwoven layers. In accordance with certain embodiments of the invention, the first DHL nonwoven layer has a z-direction thickness from about 0.3 to about 3 mm, such as from at most about any of the following: 3, 2.75, 2.5, 2.25, 2, 1.75, 1.5, 1.25, 1.0, 0.75, and 0.5 mm and/or at least about any of the following: 0.3, 0.4, 0.5, 0.75, 1.0, 1.25, 1.5, 1.75, and 2.0 mm.

As noted above, nonwoven fabrics comprising a plurality of SMFs, such as in the form of a first DHL nonwoven layer or fabric having a first bulk density less than about 70 kg/m$^3$, such as at most about any of the following: 70, 60, 55, 50, 45, 40, 35, 30, and 25 kg/m$^3$ and/or at least about any of the following: 10, 15, 20, 25, 30, 35, 40, 45, 50, and 55 kg/m$^3$. Additionally or alternatively, the first DHL comprising a plurality of SMFs may comprise a first bonded area comprising about 25% or less, such as about 20% or less, about 18% or less, about 16% or less, about 14% or less, about 12% or less, about 10% or less, or about 8% or less, such as at most about any of the following: 25, 20, 18, 15, 14, 13, 12, 11, 10, 9, 8, 7, and 6% and/or at least about any of the following: 4, 5, 6, 7, 8, 9, 10, and 12%. In accordance with certain embodiments of the invention, the first bonded area may comprise a plurality of mechanical bonds, a plurality of thermal bonds (e.g., thermal point bonds or ultrasonic point bonds), a plurality of chemical bonds, or a combination thereof. The first bonded area, in accordance with certain embodiments of the invention, may be defined by a first plurality of discrete first bond sites, such as thermal point bonds or ultrasonic bond points.

In accordance with certain embodiments of the invention, the first plurality of discrete first bond sites may have an average distance between adjacent first bond sites from about 1 mm to about 10 mm, such as at most about any of the following: 10, 9, 8, 7, 6, 5, 4, 3.5, 3, and 2 mm and/or at least about any of the following: 1, 1.5, 2, 2.5, and 3 mm. Additionally or alternatively, the discrete first bond sites may comprise an average area from about 0.25 mm$^2$ to about 3 mm$^2$, such as at most about any of the following: 3, 2.5, 2.25, 2, 1.75, 1.5, 1.25, 1, and 0.75 mm$^2$ and/or at least about any of the following: 0.25, 0.3, 0.4, 0.5, 0.6, 0.7, 0.75, 0.8, 0.9, 1, and 1.25 mm$^2$. In accordance with certain embodiments of the invention, the SMFs comprise one or more crimped portions located between adjacent first bond sites. In this regard, the first DHL nonwoven fabric comprising SMFs and described and disclosed herein may be easily extendable or elongated in one or more directions in the x-y plane due to the "slack" between adjacent discrete bond sites due to the crimped portions of the SMFs located between the adjacent first bond sites. The first plurality of discrete first bond sites may independently extend from about 10% to about 100% through the first DHL nonwoven layer containing the SMFs in a z-direction, such as at most about any of the following: 100, 85, 75, 65, 50, 35, and 25% and/or at least about any of the following: 10, 15, 20, 25, 35, and 50%.

In accordance with certain embodiments of the invention, the nonwoven fabric may consist or comprise the first DHL, which may comprise a first basis weight from about 5 to about 75 gsm, such as at most about any of the following: 75, 70, 65, 60, 55, 50, 45, 40, 35, 30, 25, 20, 15, 12, 10, 8, and 5 gsm and/or at least about any of the following: 5, 8, 10, 12, 15, and 20.

In accordance with certain embodiments of the invention, the first DHL may comprise a plurality of SMFs comprising from about 10% to about 100% of round cross-sectional fibers, such as at most about any of the following: 100, 95, 90, 85, 75, and 50% and/or at least about any of the following: 10, 20, 25, 35, 50, and 75%. Additionally or alternatively, the first DHL may comprise a plurality of SMFs comprising from about 10% to about 100% of non-round cross-sectional fibers, such as at most about any of the following: 100, 95, 90, 85, 75, and 50% and/or at least about any of the following: 10, 20, 25, 35, 50, and 75%.

In accordance with certain embodiments of the invention, the nonwoven fabric may comprise the first DHL nonwoven layer including the plurality of SMFs and at least a second nonwoven layer that is bonded directly or indirectly to the first DHL nonwoven layer. In accordance with certain embodiments of the invention, the second nonwoven layer has a second bulk density, wherein the second bulk density is larger than the first bulk density of the first DHL nonwoven layer. The second nonwoven layer, for example, may comprises one or more spunbond layers, one or more meltblown layers, one or more carded nonwoven layers, one or more mechanically bonded nonwoven layers, or any combination thereof.

In accordance with certain embodiments of the invention, the nonwoven fabric may comprise the first DHL nonwoven layer and a second DHL nonwoven layer comprising a second plurality of SMFs, in which the second DHL nonwoven layer is bonded directly or indirectly to the second nonwoven layer such that the second nonwoven layer is located directly or indirectly between the first DHL nonwoven layer and the second DHL nonwoven layer. In this regard, for example, the loftiness and/or softness associated with DHL nonwoven layers comprising SMFs as described and disclosed herein may be realized by both an uppermost and lowermost surfaces of the nonwoven fabric.

In accordance with certain embodiments of the invention, the second nonwoven layer comprises a second bonded area comprising about 15% or more, such as about 18% or more, or about 20% or more, or about 22% or more, or about 25% or more, such as at most about any of the following: 50, 40, 35, 30, 25, 22, 20, 18, and 16% and/or at least about any of the following: 15, 16, 18, 20, 22, 25, and 30%. The second bonded area may be defined by a plurality of discrete second bond sites. The plurality of discrete second bond sites may comprise thermal bond sites, such as thermal point bonds and/or ultrasonic bonds. The plurality of discrete second bond sites may have an average distance between adjacent second bond sites from about 0.1 mm to about 10 mm, such as at most about any of the following: 10, 9, 8, 7, 6, 5, 4, 3.5, 3, 2, and 1 mm and/or at least about any of the following: 0.1, 0.25, 0.5, 0.75, 1, 1.5, 2, 2.5, and 3 mm; wherein the average distance between adjacent second bond sites may be smaller than the average distance between adjacent first bond sites. In accordance with certain embodiments of the invention, for example, the average distance between adjacent first bond sites may be from about 1.5 times to 10 times greater than the average distance between adjacent second bond sites. For example, the average distance between adjacent first bond sites may be at most about any of the following: 10, 9, 8, 7, 6, 5, 4, 3.5, 3, and 2 times greater than the average distance between adjacent second bond sites and/or at least about any of the following: 1.5, 2, 3, 4, and 5 times greater than the average distance between adjacent second bond sites. Additionally or alternatively, the discrete second bond sites may comprise an average area from about 0.25 $mm^2$ to about 3 $mm^2$, such as at most about any of the following: 3, 2.5, 2.25, 2, 1.75, 1.5, 1.25, 1, and 0.75 $mm^2$ and/or at least about any of the following: 0.25, 0.3, 0.4, 0.5, 0.6, 0.7, 0.75, 0.8, 0.9, 1, and 1.25 $mm^2$. Additionally or alternatively, the discrete second bond sites may comprise an average area from about 0.7 $\mu m^2$ to about 20 $\mu m^2$, such as at most about any of the following: 20, 18, 16, 14, 12, 10, 8, 6, and 4 $\mu m^2$ and/or at least about any of the following: 0.7, 1, 2, 3, 4, 5, 6, and 8 $\mu m^2$. In accordance with certain embodiments of the invention, the second nonwoven layer may be devoid of a crimped fiber portion located between adjacent second bond sites. Additionally or alternatively, the second nonwoven layer may include bonds other than discrete thermal bonds, such as mechanical bonding (e.g., needle-punching or hydroentanglement), through-air-bonding, or adhesive bonding, to form the consolidated second nonwoven layer.

The second nonwoven layer may comprise mono-component fibers, multi-component fibers, or both. The cross-sectional shape of the fibers forming the second nonwoven layer may comprise round cross-sectional fibers, non-round cross-sectional fibers, or a combination thereof. For example, the second nonwoven layer may include a plurality of individual layers in which at least one layer includes or consists of non-round fibers and/or at least one layer includes or consists of round fibers. The second nonwoven layer, for example, may comprise from about 10% to about 100% of round cross-sectional fibers, such as at most about any of the following: 100, 95, 90, 85, 75, and 50% and/or at least about any of the following: 10, 20, 25, 35, 50, and 75%. Additionally or alternatively, the second nonwoven layer may comprise from about 10% to about 100% of non-round cross-sectional fibers, such as at most about any of the following: 100, 95, 90, 85, 75, and 50% and/or at least about any of the following: 10, 20, 25, 35, 50, and 75%. In accordance with embodiments of the invention including non-round cross-sectional fibers as part of the second nonwoven layer, these non-round cross-sectional fibers may comprise an aspect ratio of greater than 1.5:1, such as at most about any of the following: 10:1, 9:1, 8:1, 7:1, 6:1, 5:1, 4:1, 3:1, and 2:1 and/or at least about any of the following: 1.5:1, 2:1, 2.5:1, 3:1, 4:1, 5:1, and 6:1. In accordance with certain embodiments of the invention, the second nonwoven layer may comprise crimped fibers and/or non-crimped fibers. The second nonwoven layer, for example, may comprise from about 10% to about 100% non-crimped fibers, such as at most about any of the following: 100, 95, 90, 85, 75, and 50% and/or at least about any of the following: 10, 20, 25, 35, 50, and 75%. The second nonwoven layer may, in accordance with certain embodiments of the invention, be devoid of crimped fibers.

The second nonwoven layer, in accordance with certain embodiments of the invention, may comprise a second basis weight from about 2 to about 30 gsm, such as at most about any of the following: 30, 25, 20, 15, 12, 10, 8, 6, and 4 gsm and/or at least about any of the following: 2, 3, 4, 5, 6, 8, 10, and 12 gsm. Additionally or alternatively, the second nonwoven layer density may comprise from about 80 to about 150 $kg/m^3$, such as at most about any of the following: 150, 140, 130, 120, 110, and 100 $kg/m^3$ and/or at least about any of the following: 80, 90, 100, and 110 $kg/m^3$.

The second nonwoven layer, in accordance with certain embodiments of the invention, may comprise a synthetic polymer. The synthetic polymer, for example, may comprises a polyolefin, a polyester, a polyamide, or any combination thereof. By way of example only, the synthetic polymer may comprises at least one of a polyethylene, a polypropylene, a partially aromatic or fully aromatic polyester, an aromatic or partially aromatic polyamide, an aliphatic polyamide, or any combination thereof. Additionally or alternatively, the scrim may comprise a biopolymer, such as polylactic acid (PLA), polyhydroxyalkanoates (PHA), and poly(hydroxycarboxylic) acids. Additionally or alternatively, the second nonwoven layer may comprise a natural or synthetic cellulosic fiber.

In accordance with certain embodiments of the invention, the nonwoven fabric comprises a density ratio between the second nonwoven layer density and the first density in which the density ratio may comprise from about 15:1 to about 1.3:1, such as at most about any of the following: 15:1, 12:1, 10:1, 8:1, 6:1, 5:1, 4:1, 3:1, and 2:1 and/or at least about any of the following: 1.3:1, 1.5:1, 1.75:1, 2:1, 3:1, 4:1, 5:1, 6:1, and 8:1. In accordance with certain embodiments of the invention, the nonwoven fabric comprises a bond area ratio between the second bond area and the first bond area, in which the bond area ratio may comprise from about 1.25:1 to about 10:1, such as at most about any of the following: 10:1, 8:1, 6:1, 5:1, 4:1, 3:1, and 2:1 and/or at least about any of the following: 1.25:1, 1.3:1, 1.4:1, 1.5:1, 2:1, 3:1, 4:1, and 5:1.

In accordance with certain embodiments of the invention, the first DHL nonwoven layer has a first basis weight and the second nonwoven layer has a second basis weight, in which the first basis weight and the second basis weight differ by no more than 10 gsm (e.g., no more than about 8, 5, 3, or 1 gsm) and a z-directional thickness of the first DHL nonwoven layer comprises from about 1.25 to about 15 times larger than a z-directional thickness of the second nonwoven layer, such as at most about any of the following: 15, 12, 10, 8, 6, 5, 4, 3, and 2 times larger than a z-directional thickness of the second nonwoven layer and/or at least about any of the following: 1.25, 1.5, 1.75, 2, 2.5, 3, and 5 times larger than a z-directional thickness of the second nonwoven layer.

In accordance with certain embodiments of the invention, the nonwoven fabric may comprise a first side defined by the first DHL nonwoven layer and a second side defined by the second nonwoven layer. In this regard, the first surface may be incorporated into a final article of manufacture in a manner such that the loftiness associated with the first DHL nonwoven layer can be maintained while the second side may be used for attachment to one or more other components of an intermediate or final article of manufacture.

In another aspect, the present invention provides a method of forming a plurality of SW's as described and disclosed herein. In accordance with certain embodiments of the invention, the method may comprise separately melting at least a first polymeric material to provide a first molten polymeric material and a second polymeric material to provide a second molten polymeric material, in which the first polymeric material comprises a first melt flow rate (MFR) that is less than 50 g/10 min as described and disclosed herein. The method may further comprise separately directing the first molten polymeric material and the second molten polymeric material through a spin beam assembly equipped with a distribution plate configured such that the separate first molten polymeric material and the second molten polymeric material combine at a plurality of spinnerette orifices to form molten multi-component filaments containing both the first molten polymeric material and the second molten polymeric material. The method may further comprise extruding the molten multi-component filaments from the spinnerette orifices into a quench chamber and directing quench air from at least a first independently controllable blower into the quench chamber and into contact with the molten multi-component filaments to cool and at least partially solidify the multi-component filaments to provide at least partially solidified multi-component filaments. The method may further comprise directing the at least partially solidified multi-component filaments and optionally the quench air into and through a filament attenuator and pneumatically attenuating and stretching the at least partially solidified multi-component filaments. The method may further comprise directing the at least partially solidified multi-component filaments from the attenuator into a filament diffuser unit and allowing the at least partially solidified multi-component filaments to form the one or more three-dimensional crimped portions to provide the plurality of SMFs as described and disclosed herein. In accordance with certain embodiments of the invention, the method may further comprise directing the plurality of SMFs through the filament diffuser unit and depositing the plurality of SMFs randomly upon a moving continuous air-permeable belt.

Figure 3:
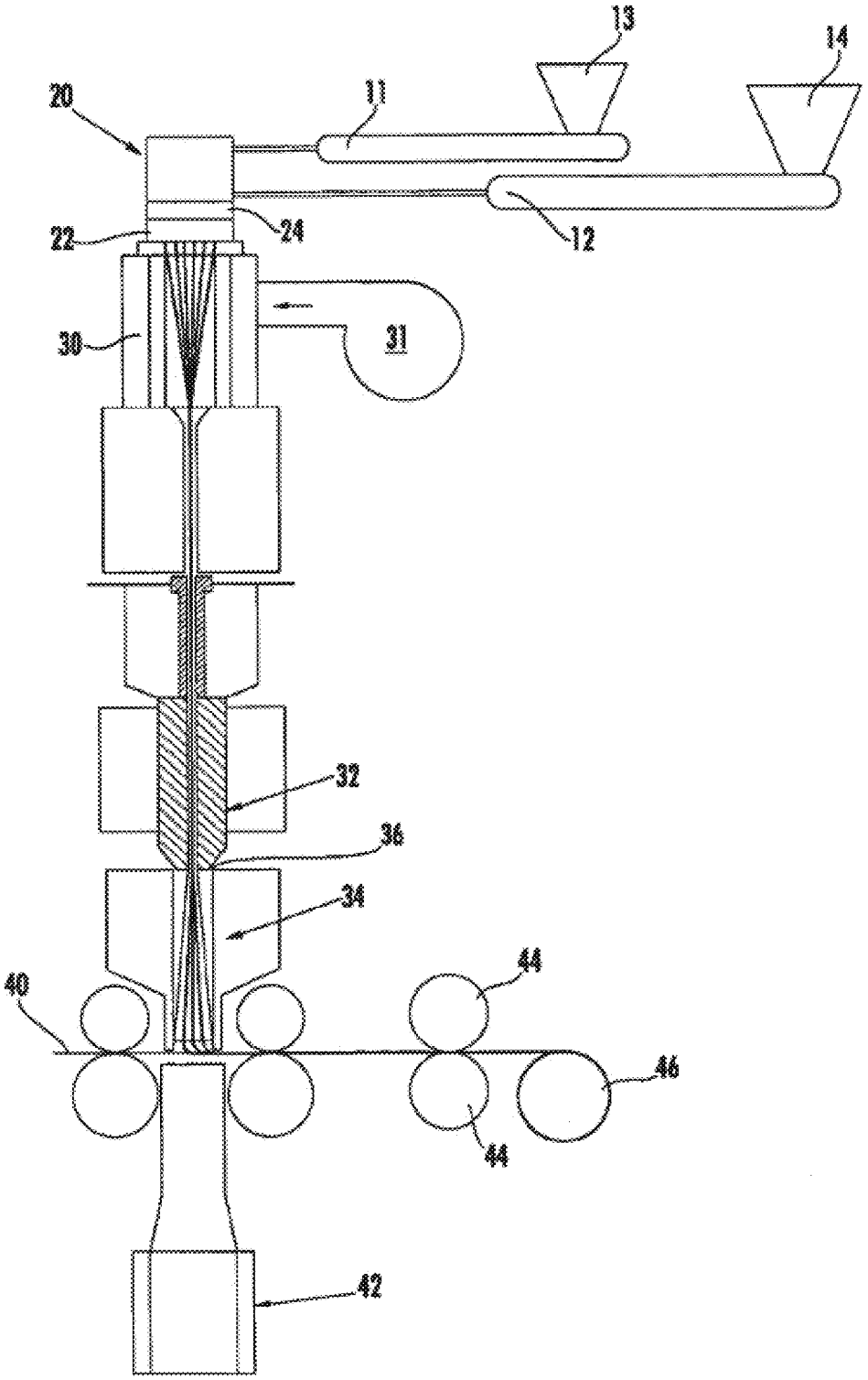
FIG. 3 is a schematic of system components (e.g., a spunbond line) for producing a multi-component spunbonded nonwoven fabric in accordance with certain embodiments of the present invention.
Figure 4:
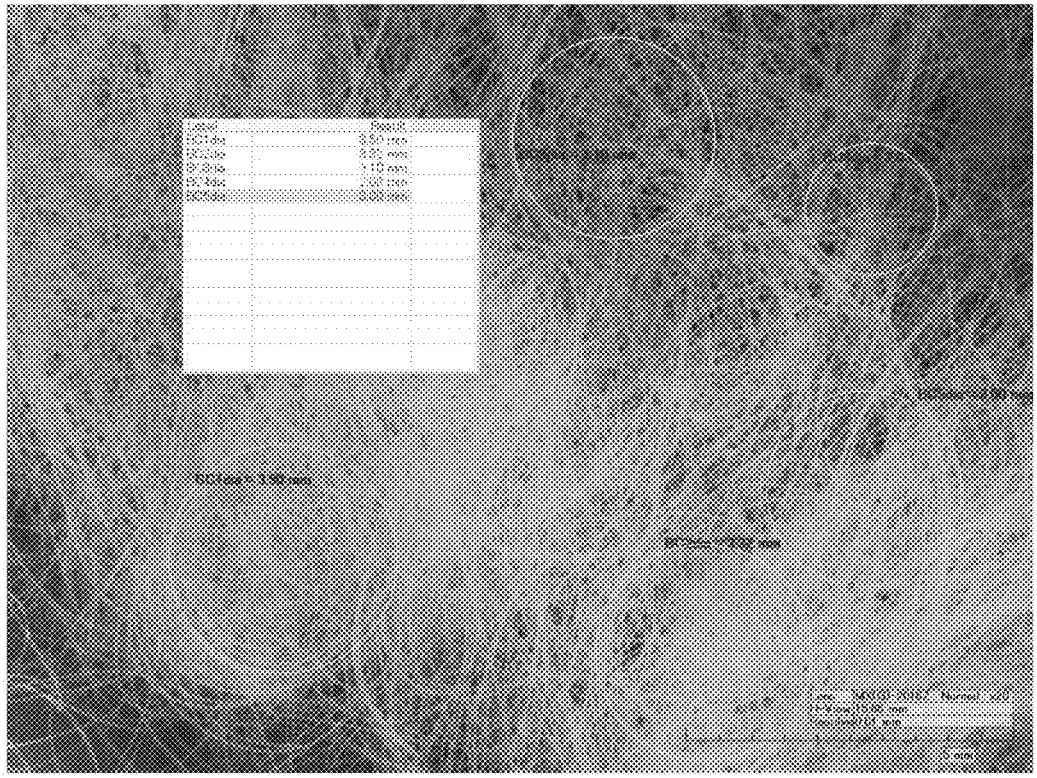
FIG. 4 is an image of a web of multi-component fibers in accordance with certain embodiments of the invention.
Figure 5:
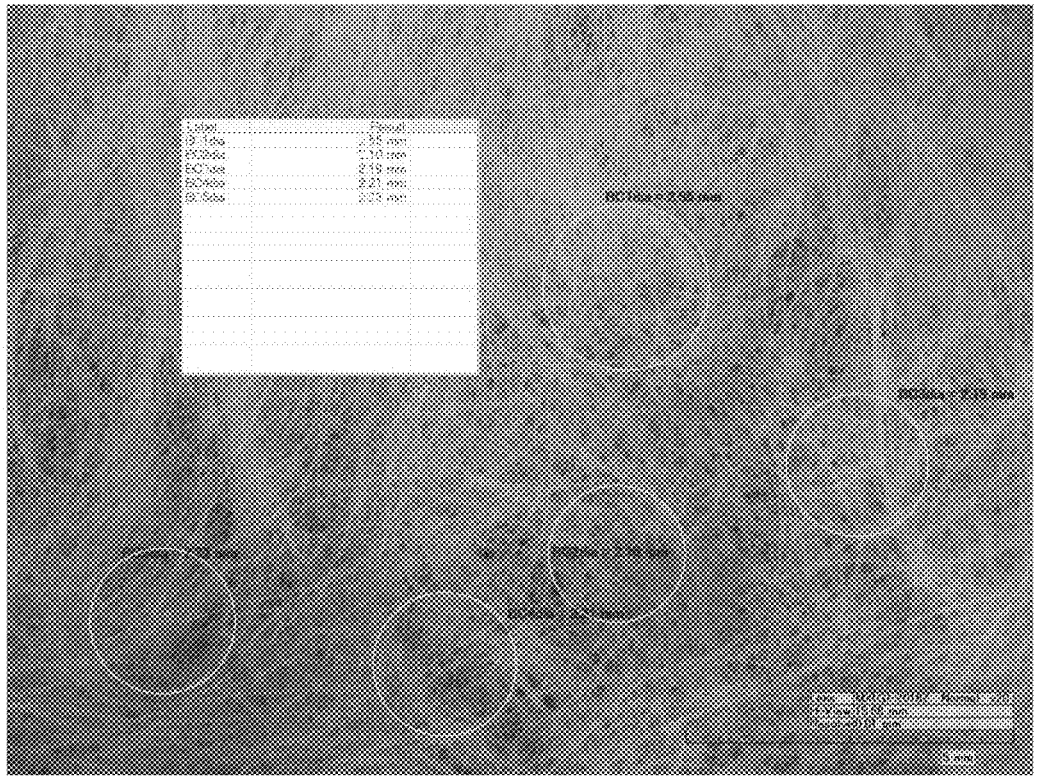
FIG. 5 is an image of a web of multi-component fibers in accordance with certain embodiments of the invention.
Figure 6:
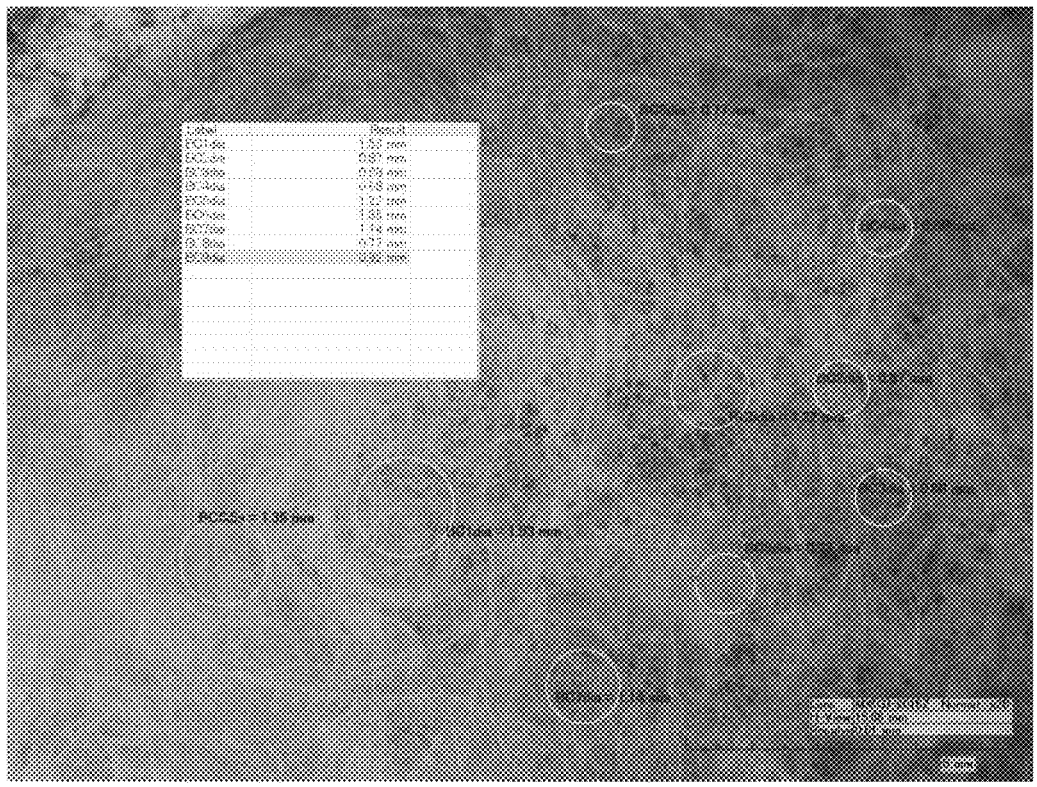
FIG. 6 is an image of a web of multi-component fibers in accordance with certain embodiments of the invention.
Figure 7:
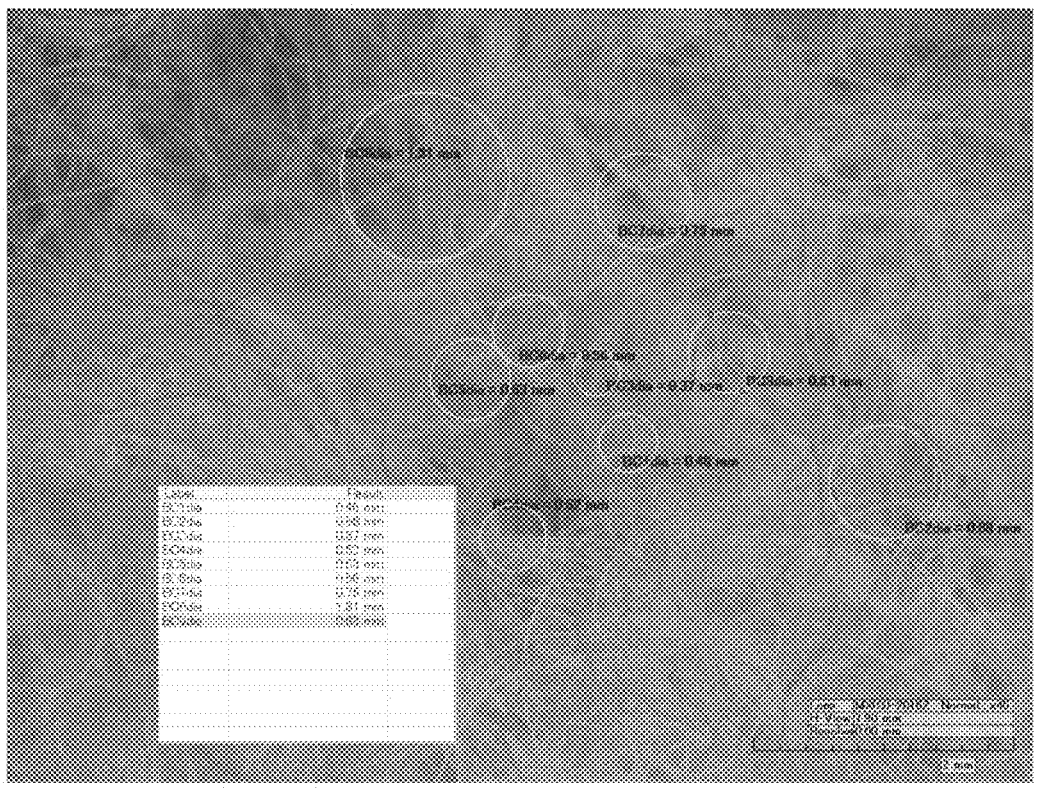
FIG. 7 is an image of a web of multi-component fibers in accordance with certain embodiments of the invention.

FIG. 3, for example, is a schematic of system components (e.g., a spunbond line) for producing a multi-component spunbonded nonwoven fabric in accordance with certain embodiments of the present invention. As illustrated in FIG. 3, the method may comprise charging raw polymeric materials (e.g., pellets, chips, flakes, etc.) into hoppers 13 (e.g., for the first polymeric composition) and 14 (e.g., for the second polymeric composition). The method may further comprise separately melting at least a first polymeric material to provide a first molten polymeric material through extruder 11 and a second polymeric material to provide a second molten polymeric material through extruder 12, in the extruders 11,12 include a heated extruder barrel in which an extruder screw may be mounted. In this regard, the extruder screws (not shown) may include convolutions or flights configured for conveying the polymeric materials through a series of heating zones while the polymer materials are heated to a molten state and mixed by the extruder screw. The method may further comprise separately directing the first molten polymeric material and the second molten polymeric material through a spin beam assembly 20 equipped with a distribution plate configured such that the separate first molten polymeric material and the second molten polymeric material combine at a plurality of spinnerette orifices to form molten multi-component filaments containing both the first molten polymeric material and the second molten polymeric material. As shown in FIG. 3, the spin beam assembly 20 is operatively and/or fluidly connected to the discharge ends of extruders 11,12. The spin beam assembly 20 may extend in the cross-direction of the apparatus and define the width of the nonwoven web of SMFs to be manufactured. In accordance with certain embodiments of the invention, one or more replaceable spin packs may be mounted to the spin beam assembly 20, in which the one or more replaceable spin packs may be configured to receive first molten polymeric material and the second molten polymeric material, and direct the first molten polymeric material and the second molten polymeric material through fine capillaries formed in a spinnerette plate 22. For example, the spinnerette plate 22 may include a plurality of spinnerette orifices. Upstream from the spinnerette plate 22, as shown in FIG. 3, a distribution plate 24 may be provided that forms channels for separately conveying the first molten polymeric material and the second molten polymeric material to the spinnerette plate 22. The channels in the distribution plate 24 may be configured to act as pathways for the separate first molten polymeric material and second molten polymeric material as well as to direct these two molten polymeric materials to the appropriate spinnerette inlet locations so that the separate first molten polymeric material and second molten polymeric materials combine at the entrance end of the spinnerette orifice to produce a desired geometric pattern within the filament cross section. As the molten polymer materials are extruded from the spinnerette orifices, the separate first and second polymeric compositions occupy distinct areas or zones of the filament cross section as described and disclosed herein (e.g., eccentric sheath/core, side-by-side, segmented pie, islands-in-the-sea, tipped multi-lobed, etc.). The spinnerette orifices, as such, may be either of a round cross-section or of a variety of non-round cross-sections having an aspect ratio as described and disclosed herein (e.g., trilobal, quadralobal, pentalobal, dog bone shaped, delta shaped, etc.) for producing filaments of various cross-sectional geometries.

The method may further comprise extruding the molten multi-component filaments from the spinnerette orifices into a quench chamber and directing quench air from at least a first independently controllable blower into the quench chamber and into contact with the molten multi-component filaments to cool and at least partially solidify the multi-component filaments to provide at least partially solidified multi-component filaments. As shown in FIG. 3, for example, upon leaving the spinnerette plate 22, the freshly extruded molten multi-component filaments are directed downwardly through a quench chamber 30. Air from an independently controlled blower 31 may be directed into the quench chamber 30 and into contact with the molten multi-component filaments in order to cool and at least partially solidify the molten multi-component filaments. As used herein, the term "quench" simply means reducing the temperature of the fibers using a medium that is cooler than the fibers such as, for example, ambient air. In this regard, quenching of the fibers can be an active step or a passive step (e.g., simply allowing ambient air to cool the molten fibers). In accordance with certain embodiments of the invention, the fibers may be sufficiently quenched to prevent their sticking/adhering to the draw unit. Additionally or alternatively, the fibers may be substantially uniformly quenched such that significant temperature gradients are not formed within the quenched fibers. As the at least partially solidified multi-component filaments continue to move downwardly, they enter into a filament attenuator 32. As the at least partially solidified multi-component filaments and quench air pass through the filament attenuator 32, the cross sectional configuration of the attenuator causes the quench air from the quench chamber to be accelerated as it passes downwardly through the attenuation chamber. The at least partially solidified multi-component filaments, which are entrained in the accelerating air, are also accelerated and the at least partially solidified multi-component filaments are thereby attenuated (stretched) as they pass through the attenuator.

The method may further comprise directing the at least partially solidified multi-component filaments from the attenuator into a filament diffuser unit 34 and allowing the at least partially solidified multi-component filaments to form the one or more three-dimensional crimped portions to provide the plurality of SMFs as described and disclosed herein. FIG. 3, for example, illustrate a filament diffuser unit 34 mounted beneath the filament attenuator 32. The filament diffuser 34 may be configured to randomly distribute the at least partially solidified multi-component filaments as they are laid down upon an underlying moving endless air-permeable belt 40 to form an unbonded web of randomly arranged SMFs in accordance with certain embodiments of the invention as described and disclosed herein. The filament diffuser unit 34 may comprise a diverging geometry with adjustable side walls. Beneath the air-permeable belt 40 is a suction unit 42 which draws air downwardly through the filament diffuser unit 34 and assists in the lay-down of the SMFs on the air-permeable belt 40. An air gap 36 may optionally be provided between the lower end of the attenuator 32 and the upper end of the filament diffuser unit 34 to admit ambient air into the filament diffuser unit to assist in obtaining a consistent but random filament distribution to provide good uniformity in both the machine direction and the cross-machine direction of the laid web of SMFs. The quench chamber, filament attenuator, and filament diffuser unit are available commercially from Reifenhauser GmbH & Company Machinenfabrik of Troisdorf, Germany and is sold commercially by Reifenhauser as the "Reicofil 3", "Reicofil 4", and "Reicofil 5" systems.

In yet another aspect, the present invention provides a method of forming a nonwoven fabric as disclosed and described herein. In accordance with certain embodiments of the invention, for instance, the method may comprise forming or providing a first disposable-high-loft ("DHL") nonwoven web (e.g., unconsolidated) comprising a first plurality of randomly deposited SMFs and consolidating the first DHL nonwoven web to provide a first DHL nonwoven layer. In accordance with certain embodiments of the invention, the step of forming the first DHL nonwoven web may comprise methods of forming a plurality of SMFs as described and disclosed above and illustrated, by way of example, in FIG. 3. For example, FIG. 3 illustrates that the web of SMFs deposited on the continuous endless moving belt 40 may be subsequently directed through a bonder 44 and consolidated to form a coherent nonwoven fabric as described and disclosed herein (e.g., the first DHL nonwoven), in which the nonwoven fabric may be collected on a roll 46. In this regard, the method may comprise directing the nonwoven web of unbonded SMFs through a bonder and consolidating the plurality of SMFs to convert the nonwoven web into the nonwoven fabric (e.g., DHL).

In accordance with certain embodiments of the invention, the consolidating step may comprise a mechanically bonding operation, a thermal bonding operation, an adhesive bonding operation, or any combination thereof. For example, the consolidation of the of the SMF nonwoven web may be carried out by a variety of means including, for example, thermal bonding (e.g., through-air-bonding, thermal calendering, or ultrasonic bonding), mechanical bonding (e.g., needle-punching or hydroentanglement), adhesive bonding, or any combination thereof.

In accordance with certain embodiments of the invention, the method may further comprise forming or providing a second nonwoven layer and directly or indirectly bonding a first side of the second nonwoven layer to the first DHL nonwoven layer as described and disclosed herein. In accordance with certain embodiments of the invention, the method may comprise directly or indirectly bonding a second side of the second nonwoven layer to a second DHL nonwoven layer to provide a nonwoven fabric as described herein. In accordance with certain embodiments of the invention, the method may comprise melt-spinning a precursor second nonwoven web and consolidating the precursor second nonwoven web, such as by mechanical bonding (e.g., needle-punching or hydroentanglement), thermal bonding (e.g., through-air-bonding, thermal calendering, or ultrasonic bonding), or adhesive bonding, to form the second nonwoven layer. Additionally or alternatively, the method may comprise melt-spinning a precursor first DHL nonwoven layer (i.e., first DHL nonwoven web) directly or indirectly onto the second nonwoven layer and consolidating the precursor DHL nonwoven layer (i.e., first DHL nonwoven web) to form the DHL nonwoven layer and in certain embodiments to simultaneously bond the first side of the second nonwoven layer to the first DHL nonwoven layer. The consolidation of the of the precursor DHL nonwoven layer (i.e., first DHL nonwoven web) may be carried out by a variety of means including, for example, thermal bonding (e.g., through-air-bonding, thermal calendering, or ultrasonic bonding), mechanical bonding (e.g., needle-punching or hydroentanglement), adhesive bonding, or any combination thereof.

In another aspect, the present invention provides a hygiene-related article (e.g., diaper), in which one or more of the components of the hygiene-related article comprises a nonwoven fabric as described and disclosed herein. Nonwoven fabric, in accordance with certain embodiments of the invention, may be incorporated into infant diapers, adult diapers, and femcare articles (e.g., as or as a component of a topsheet, a backsheet, a waistband, as a legcuff, etc.).

EXAMPLES

The present disclosure is further illustrated by then following examples, which in no way should be construed as being limiting. That is, the specific features described in the following examples are merely illustrative and not limiting.

A: Blends of Polypropylene

A variety of polypropylene blends were formed by blending a polypropylene homopolymer having a melt flow rate of 35 g/10 min (i.e., ExxonMobil 3155PP) with varying amounts of a meltblown polypropylene resin having a MFR of 1200 g/10 min (i.e., TOTAL Polypropylene 3962). Table 1 below shows the resulting MFR for the various blends. Table 2 shows the molar mass averages (g/mol) and polydispersity (e.g., molecular weight distribution: $M_w/M_n$) of the polypropylene homopolymer having a melt flow rate of 35 g/10 min (i.e., ExxonMobil 3155PP) and for a blend of ExxonMobil 3155PP including 6% by weight of TOTAL Polypropylene 3962.

TABLE 1

| n | Time (s) | MFR g/10 min |
|---|---|---|
| | Run#1: 1 wt % meltblown PP | |
| 1 | 5.14 | 38.9 |
| 2 | 5.19 | 38.5 |
| 3 | 5.25 | 38.1 |
| 4 | 5.30 | 37.7 |
| 5 | 5.18 | 38.6 |
| 6 | 5.23 | 38.2 |
| | Average | 38.4 |
| | Maximum | 38.9 |
| | Minimum | 37.7 |
| | SD | 0.4 |
| | Run#2: 2 wt % meltblown PP | |
| 1 | 5.16 | 38.8 |
| 2 | 5.11 | 39.1 |
| 3 | 5.19 | 38.5 |
| 4 | 5.02 | 39.8 |
| 5 | 5.06 | 39.5 |
| 6 | 4.98 | 40.2 |
| | Average | 39.3 |
| | Maximum | 40.2 |
| | Minimum | 38.5 |
| | SD | 0.6 |
| | Run#3: 3 wt % meltblown PP | |
| 1 | 4.13 | 48.4 |
| 2 | 4.58 | 43.7 |
| 3 | 4.05 | 49.4 |
| 4 | 4.20 | 47.6 |
| 5 | 4.26 | 46.9 |
| 6 | 4.37 | 45.8 |
| | Average | 47.0 |
| | Maximum | 49.4 |
| | Minimum | 43.7 |
| | SD | 2.0 |
| | Run#4: 4 wt % meltblown PP | |
| 1 | 3.75 | 53.3 |
| 2 | 4.01 | 49.9 |
| 3 | 3.67 | 54.5 |
| 4 | 3.88 | 51.5 |
| 5 | 3.53 | 56.7 |
| 6 | 3.83 | 52.2 |
| | Average | 53.0 |
| | Maximum | 56.7 |
| | Minimum | 49.9 |
| | SD | 2.4 |
| | Run#5: 5 wt % meltblown PP | |
| 1 | 3.38 | 59.2 |
| 2 | 3.56 | 56.2 |
| 3 | 3.50 | 57.1 |
| 4 | 3.50 | 57.1 |
| 5 | 3.46 | 57.8 |
| 6 | 3.25 | 61.5 |
| | Average | 58.2 |
| | Maximum | 61.5 |
| | Minimum | 56.2 |
| | SD | 1.9 |
| | Run#6: 6 wt % meltblown PP | |
| 1 | 3.10 | 64.5 |
| 2 | 2.92 | 68.5 |
| 3 | 3.04 | 65.8 |
| 4 | 3.29 | 60.8 |
| 5 | 3.05 | 65.6 |
| 6 | 3.13 | 63.9 |
| | Average | 64.8 |
| | Maximum | 68.5 |
| | Minimum | 60.8 |
| | SD | 2.5 |
| | Run#7: 7 wt % meltblown PP | |
| 1 | 3.15 | 63.5 |
| 2 | 3.13 | 63.9 |
| 3 | 3.04 | 65.8 |
| 4 | 3.21 | 62.3 |
| 5 | 3.17 | 63.1 |
| 6 | 3.21 | 62.3 |
| | Average | 63.5 |
| | Maximum | 65.8 |
| | Minimum | 62.3 |
| | SD | 1.3 |
| | Run#8: 8 wt % meltblown PP | |
| 1 | 3.04 | 65.8 |
| 2 | 3.05 | 65.6 |
| 3 | 2.95 | 67.8 |
| 4 | 3.00 | 66.7 |
| 5 | 2.92 | 68.5 |
| 6 | 2.96 | 67.6 |
| | Average | 67.0 |
| | Maximum | 68.5 |
| | Minimum | 65.6 |
| | SD | 1.2 |

TABLE 2

| Sample Identification | Injection | Molar Mass Averages (g/mol) $M_n$ | $M_w$ | $M_z$ | $M_w/M_n$ |
|---|---|---|---|---|---|
| Polypropylene Exxon 3155 ES resin (Pellets) (35 MFR) (SGS PSI 21996-01) | 1 | 33,700 | 276,500 | 609,700 | 8.21 |
| | 2 | 36,800 | 275,800 | 615,800 | 7.49 |
| | Average | 35,300 | 276,100 | 612,700 | 7.85 |
| | Std. Dev. | 2,200 | 510 | 4,320 | 0.51 |
| Polypropylene Fibers - Blend of 94% Exxon 3155 ES + 6% Total 3962 (1200 MFR) (SGS PSI 21996-02) | 1 | 28,000 | 239,800 | 509,500 | 8.55 |
| | 2 | 27,700 | 239,700 | 505,500 | 8.66 |
| | Average | 27,900 | 239,800 | 507,500 | 8.61 |
| | Std. Dev. | 250 | 80 | 2,830 | 0.08 |

As can be seen from Table 1, the addition of 3% by weight of the meltblown polypropylene resin having a MFR of 1200 g/10 min (i.e., TOTAL Polypropylene 3962) provided polymeric composition having a MFR of less than 50 g/10 min. Table 2 illustrates that the polypropylene homopolymer having a melt flow rate of 35 g/10 min (i.e., ExxonMobil 3155PP) alone and a resulting polymeric blend of the 3155PP and Polypropylene 3962 do not generally have a narrow molecular weight distribution as shown by polydispersity (e.g., $M_w/M_n$) values in excess of 7.5.

B: Webs Containing Polypropylene/Polyethylene Bi-Component Side-By-Side Self-Crimped Fibers Several spunbond webs were formed on a spundbond system. In particular, a plurality of round side-by-side bicomponent fibers were produced with the first component formed from a polypropylene blend and the second component was formed from a linear low density polyethylene having a melt flow rate of 30 g/10 min (i.e., Aspun PE 6850 from Dow). The first component (i.e., the polypropylene blend) was formed from a polypropylene homopolymer having a melt flow rate of 35 g/10 min (i.e., ExxonMobil 3155PP) with varying amounts of a meltblown polypropylene resin having a MFR of 1200 g/10 min (i.e., TOTAL Polypropylene 3962). Table 3 summarizes the relative amounts of the meltblown polypropylene resin having a MFR of 1200 g/10 min (i.e., TOTAL Polypropylene 3962) present in the various samples. As shown in Table 3, for example, the meltblown polypropylene resin having a MFR of 1200 g/10 min (i.e., TOTAL Polypropylene 3962) was present at a level of 1% by weight of the resulting multi-component fiber and present at about 1.7 wt. % of the polypropylene blend (e.g., Ho Extruder) in Run 1.

TABLE 3

| | Ho Extruder | | | Co Extruder | | |
|---|---|---|---|---|---|---|
| | Wt. % of 315PP from Exxon of Resulting Fiber | Wt. % of 3962 Meltblown-PP 1200 MFR of Resulting Fiber | Wt. % of 3962 in Ho Extruder | Wt. % Aspun PE 6850 (Dow) of Resulting Fiber | Resulting Fiber Check (%) | Avg. Diameter of Crimped Portions (mm) |
| Run 1 | 59 | 1 | 1.7 | 40 | 100 | 2.99 |
| Run 2 | 58 | 2 | 3.3 | 40 | 100 | 2.26 |
| Run 3 | 57 | 3 | 5.0 | 40 | 100 | 1.06 |
| Run 4 | 56 | 4 | 6.7 | 40 | 100 | 0.68 |

The average diameters for the crimped portions (e.g., helical crimps) were determined for each run. Run 1 had an average diameter for the crimped portions was 2.99 mm. Run 2 had an average diameter for the crimped portions was 2.26 mm. Run 3 had an average diameter for the crimped portions was 1.06 mm. Run 4 had an average diameter for the crimped portions was 0.68 mm. In this regard, the average diameter of the resulting crimped portions may be tunable based on the blending of the low MFR polypropylene with notably higher MFR meltblown polypropylene. For example, a tighter or smaller average crimp diameter was realized with increasing amount of the higher MFR meltblown polypropylene present in the polypropylene blend. Images of the fibers from Runs 1-4 are provided in FIGS. 4-7, respectively. In accordance with certain embodiments of the invention, the average diameter of the plurality of three-dimensional crimped portions were be ascertained by use of a digital optical microscope (Manufactured by HiRox in Japan KH-7700) to view the samples and obtain digital measurement of loop diameters of the three-dimensional crimped portions of the SMFs. Magnification ranges generally in the 20× to 40× were used to ease evaluation of the loop diameter formed from the three-dimensional crimping of the SMFs.

Figure 8:
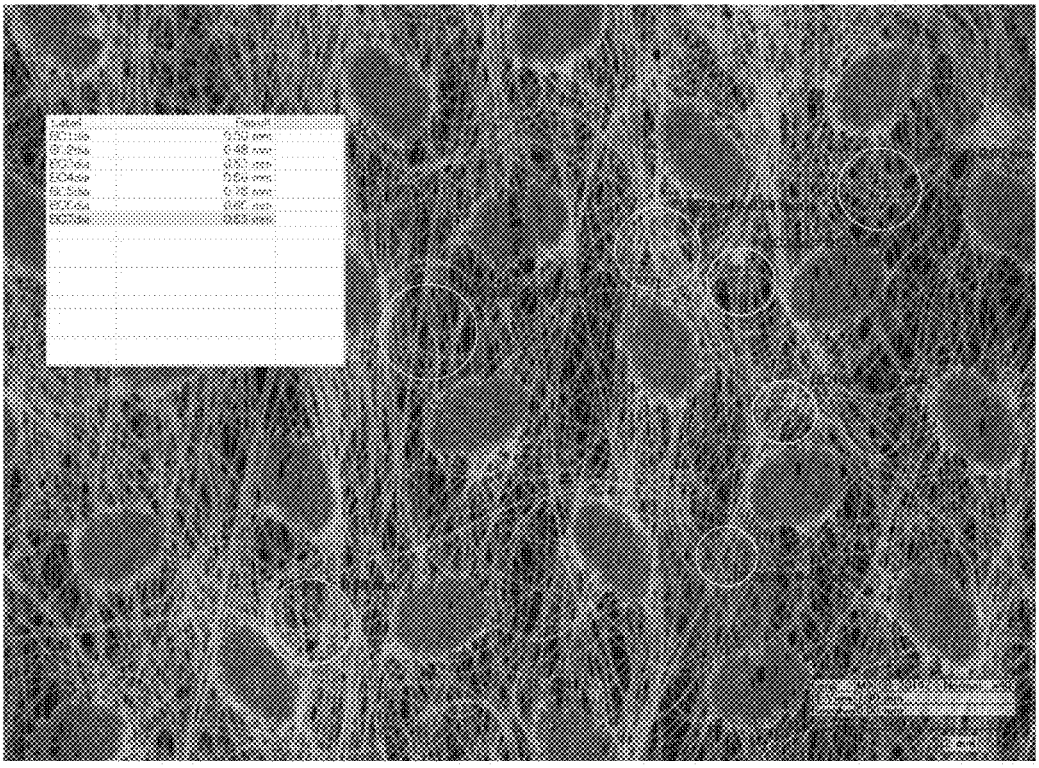
FIG. 8 is an image of a web of multi-component fibers in accordance with certain embodiments of the invention.
Figure 9:
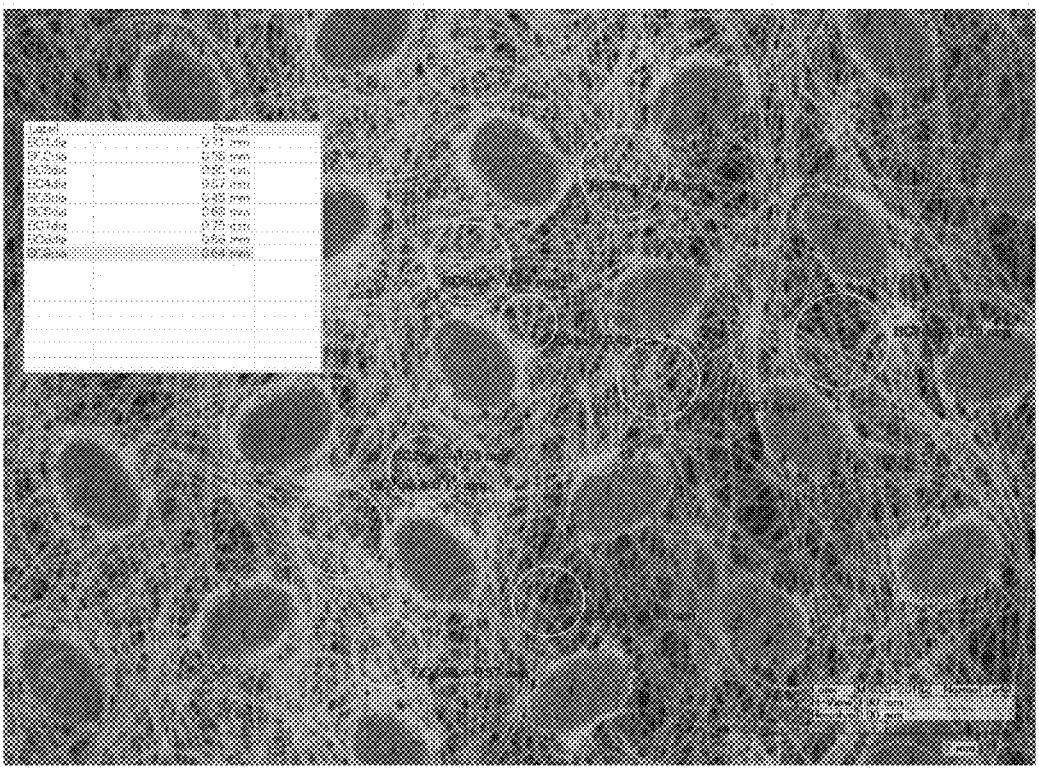
FIG. 9 is an image of a web of multi-component fibers in accordance with certain embodiments of the invention.
Figure 10:
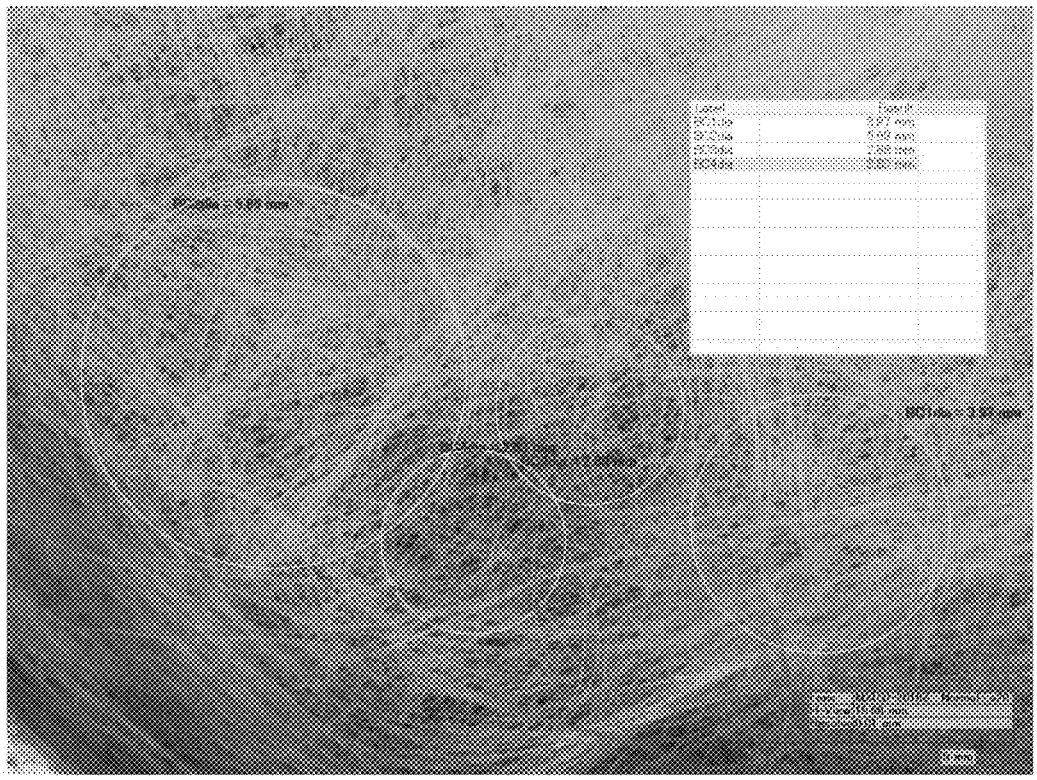
FIG. 10 is an image of a web of multi-component fibers in accordance with certain embodiments of the invention.
Figure 11:
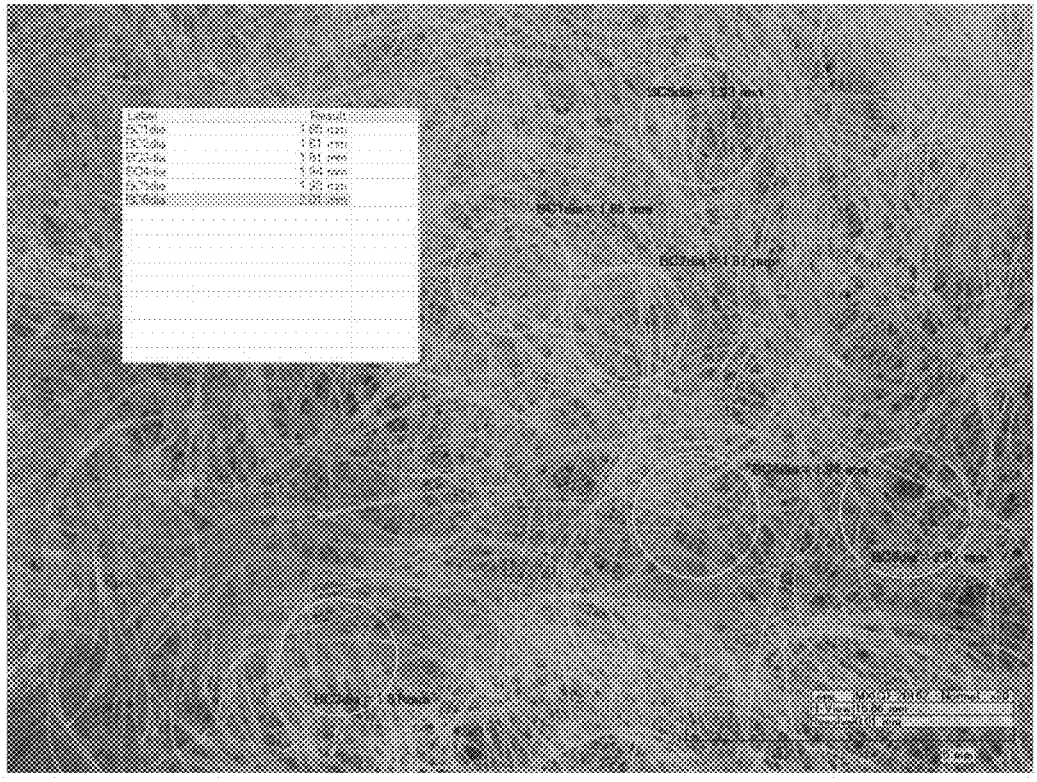
FIG. 11 is an image of a web of multi-component fibers in accordance with certain embodiments of the invention.
Figure 12:
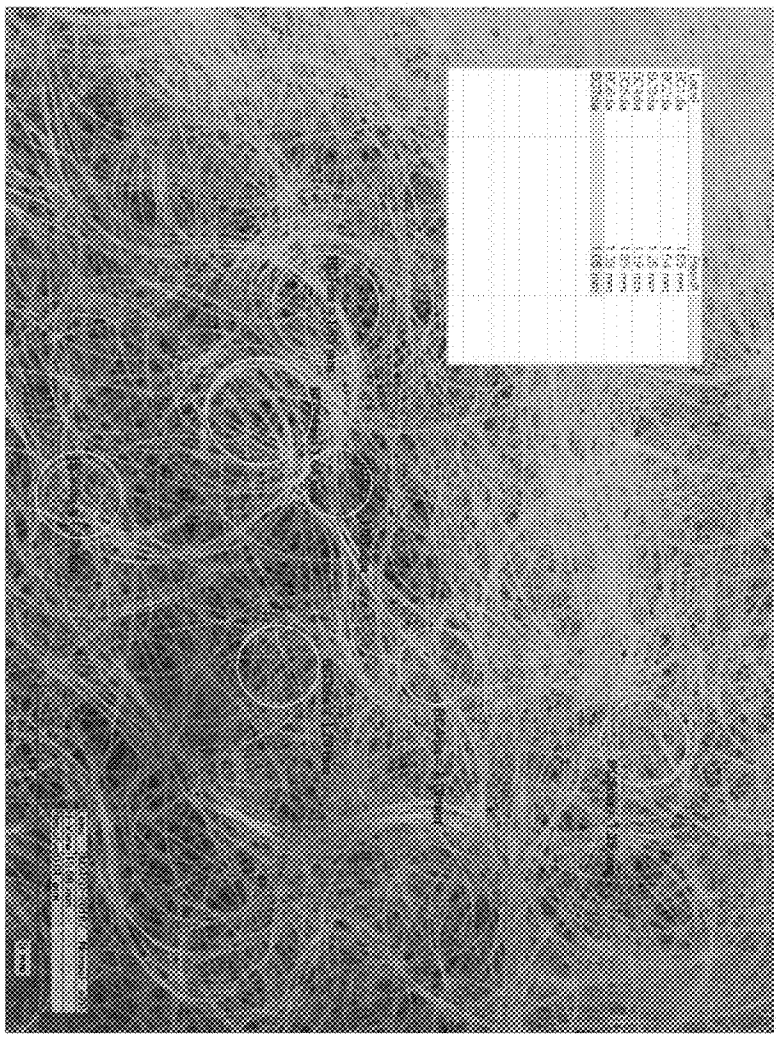
FIG. 12 is an image of a web of multi-component fibers in accordance with certain embodiments of the invention.
Figure 13:
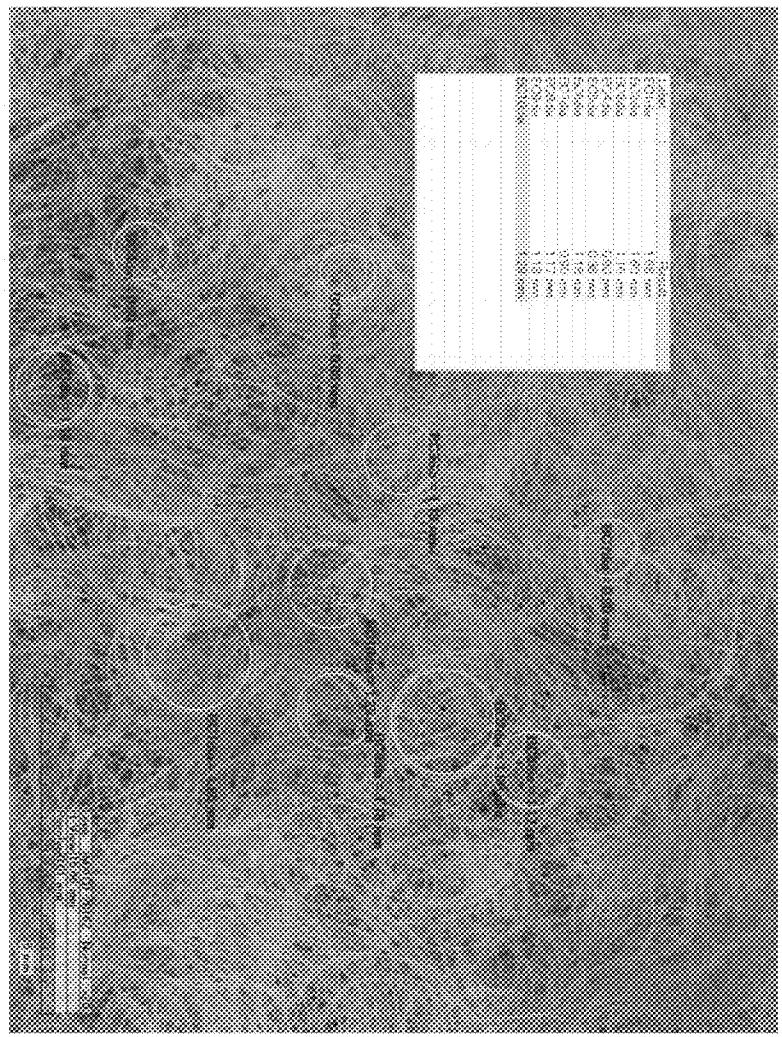
FIG. 13 is an image of a web of multi-component fibers in accordance with certain embodiments of the invention.

FIGS. 8 and 9 show images of fibers showing spunbond webs formed on a spunbond Reicofil system (i.e., Generation 5). The web shown in FIG. 8 is a 15 gsm web of self-crimped multi-component fibers being PP/PE side-by-side fibers having an overall polypropylene content of 60% by weight (including 3% by weight of the meltblown polypropylene in the first component/polypropylene blend). FIG. 9 is a 20 gsm web of an identical construction to that of FIG. 8. The fibers of FIG. 8 had an average diameter for the crimped portions of 0.61 mm while the fibers of FIG. 9 had an average diameter for the crimped portions of 0.62 mm. As noted above, these samples were produced on a spunbond Reicofil system (i.e., Generation 5) as generally illustrated in FIG. 3 and the polypropylene side of the SMF included 3% by weight of the meltblown polypropylene resin having a MFR of 1200 g/10 min (i.e., TOTAL Polypropylene 3962). Interestingly, the average diameter of the crimped portions for these samples were tighter/smaller for the same amount of the meltblown polypropylene resin present in the polypropylene side of the fibers. This noted difference is believed to be related, at least in part, to the laydown process on the Reicofil system (i.e., Generation 5) which has a more "gentle" diffused laydown device allowing the generation of slightly smaller diameter coils (e.g., crimped portions).

C: Webs Containing Polypropylene/Polypropylene Bi-Component Side-By-Side Self-Crimped Fibers Several spunbond webs were formed on a spunbond system. In particular, a plurality of round side-by-side bicomponent fibers were produced with the first component formed from a polypropylene blend and the second component was formed from a polypropylene homopolymer having a melt flow rate of 35 g/10 min (i.e., ExxonMobil 3155PP). The first component (i.e., the polypropylene blend) was formed from a polypropylene homopolymer having a melt flow rate of 35 g/10 min (i.e., ExxonMobil 3155PP) with varying amounts of a meltblown polypropylene resin having a MFR of 1200 g/10 min (i.e., TOTAL Polypropylene 3962). Table 4 summarizes the relative amounts of the meltblown polypropylene resin having a MFR of 1200 g/10 min (i.e., TOTAL Polypropylene 3962) present in the various samples. As shown in Table 4, for example, the meltblown polypropylene resin having a MFR of 1200 g/10 min (i.e., TOTAL Polypropylene 3962) was present at a level of 1% by weight of the resulting multi-component fiber and present at about 1.7 wt. % of the polypropylene blend (e.g., Ho Extruder) for Run 5.

TABLE 4

| | Ho Extruder | | | Co Extruder | | |
|---|---|---|---|---|---|---|
| | Wt. % of 315PP from Exxon of Resulting Fiber | Wt. % of 3962 Meltblown-PP 1200 MFR of Resulting Fiber | Wt. % of 3962 in Ho Extruder | Wt. % of 315PP from Exxon of Resulting Fiber | Resulting Fiber Check (%) | Avg. Diameter of Crimped Portions (mm) |
| Run 5 | 59 | 1 | 1.7 | 40 | 100 | 3.91 |
| Run 6 | 58 | 2 | 3.3 | 40 | 100 | 1.89 |
| Run 7 | 57 | 3 | 5.0 | 40 | 100 | 1.35 |
| Run 8 | 56 | 4 | 6.7 | 40 | 100 | 1.19 |

The average diameters for the crimped portions (e.g., helical crimps) were determined for each run. Run 5 had an average diameter for the crimped portions was 3.91 mm. Run 6 had an average diameter for the crimped portions was 1.89 mm. Run 7 had an average diameter for the crimped portions was 1.35 mm. Run 8 had an average diameter for the crimped portions was 1.19 mm. In this regard, the average diameter of the resulting crimped portions may be tunable based on the blending of the low MFR polypropylene with notably higher MFR meltblown polypropylene. For example, a tighter or smaller average crimp diameter was realized with increasing amount of the higher MFR meltblown polypropylene present in the polypropylene blend. Images of the fibers from Runs 5-8 are provided in FIGS. 10-13, respectively.

Figure 14:
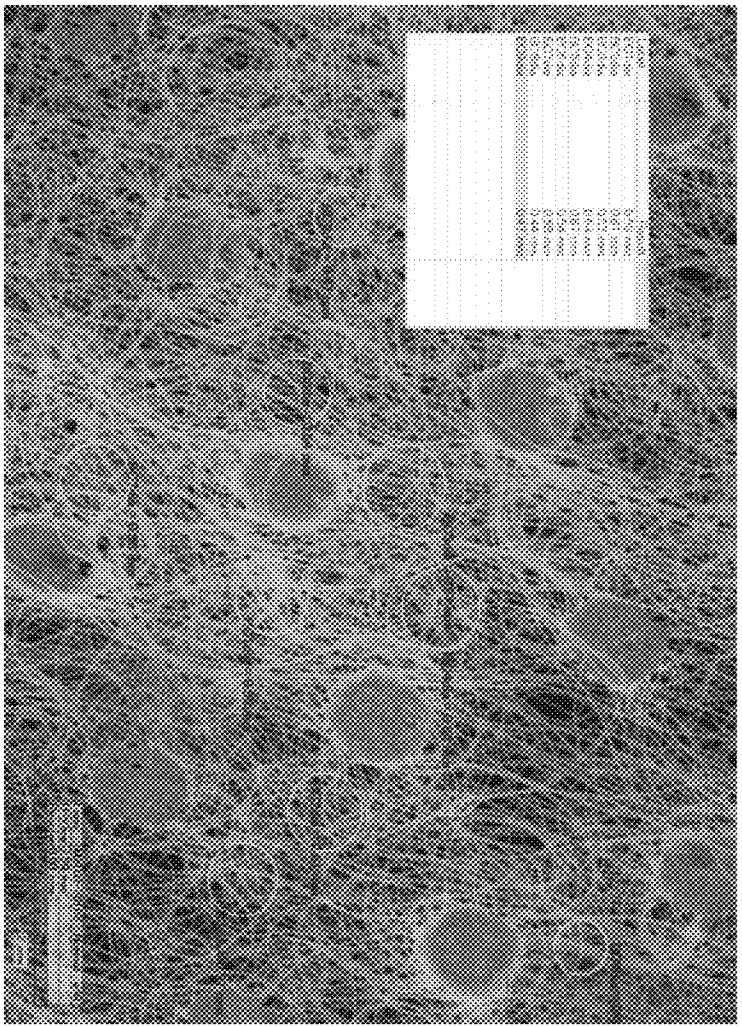
FIG. 14 is an image of a web of multi-component fibers in accordance with certain embodiments of the invention.
Figure 15:
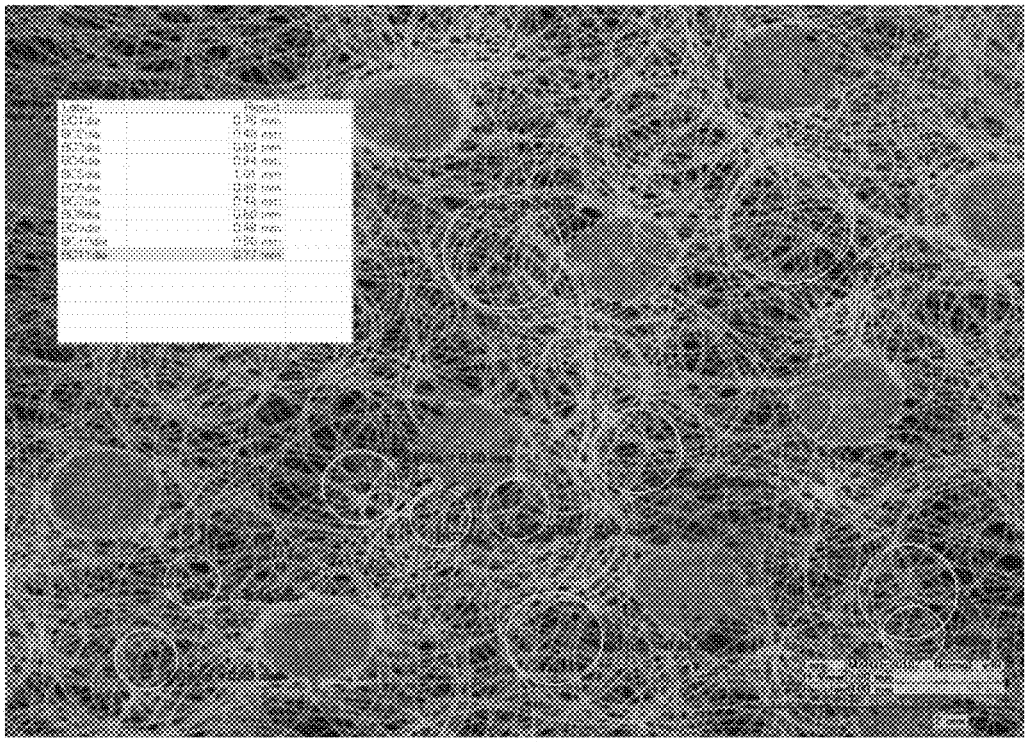
FIG. 15 is an image of a web of multi-component fibers in accordance with certain embodiments of the invention.

FIGS. 14 and 15 show images of fibers showing spunbond webs formed on a spunbond Reicofil system (i.e., Generation 5). The web shown in FIG. 14 is a 21 gsm web of self-crimped multi-component fibers being PP/PP side-by-side fibers having an overall polypropylene content of 60% by weight (including 3% by weight of the meltblown polypropylene in the first component/polypropylene blend). FIG. 15 is a 19 gsm web of an identical construction to that of FIG. 14. The fibers of FIG. 14 had an average diameter for the crimped portions of 0.57 mm while the fibers of FIG. 15 had an average diameter for the crimped portions of 0.60 mm. As noted above, these samples were produced on a spunbond Reicofil system (i.e., Generation 5) as generally illustrated in FIG. 3 and the polypropylene side of the SMF included 3% by weight of the meltblown polypropylene resin having a MFR of 1200 g/10 min (i.e., TOTAL Polypropylene 3962). Interestingly, the average diameter of the crimped portions for these samples were tighter/smaller for the same amount of the meltblown polypropylene resin present in the polypropylene side of the fibers. This noted difference is believed to be related, at least in part, to the laydown process on the Reicofil system (i.e., Generation 5) which has a more "gentle" diffused laydown device allowing the generation of slightly smaller diameter coils (e.g., crimped portions).

These and other modifications and variations to the invention may be practiced by those of ordinary skill in the art without departing from the spirit and scope of the invention, which is more particularly set forth in the appended claims. In addition, it should be understood that aspects of the various embodiments may be interchanged in whole or in part. Furthermore, those of ordinary skill in the art will appreciate that the foregoing description is by way of example only, and it is not intended to limit the invention as further described in such appended claims. Therefore, the spirit and scope of the appended claims should not be limited to the exemplary description of the versions contained herein.

That which is claimed:

1. A self-crimped multi-component fiber (SMF), comprising:

(i) a first component comprising a first polymeric material, wherein the first polymeric material comprises a first melt flow rate (MFR) less than 50 g/10 min; the first polymeric material is formed from a blend of a first polyolefin fraction A consisting of a first polypropylene and having a melt flow rate-A (MFR-A) and a polyolefin fraction B consisting of a second polypropylene and having a melt flow rate-B (MFR-B); wherein the first polymeric material comprises from 0.5 to 12% by weight of the second polypropylene and a MFR-ratio between MFR-B and MFR-A is from 15:1 to 100:1; and (ii) a second component comprising a second polymeric material, wherein the second component is formed from a polyethylene; wherein the SMF comprises one or more three-dimensional crimped portions.

2. The SMF fiber of claim 1, wherein the SMF comprises a staple fiber, a discontinuous meltblown fiber, or a continuous fiber.

3. The SMF of claim 2, wherein the SMF comprises a bicomponent spunbond fiber.

4. The SMF of claim 1, wherein the SMF comprises an average free crimp percentage from 30% to 300.

5. The SMF of claim 1, wherein the one or more three-dimensional crimped portions include at least one discrete zig-zag configured crimped portion, at least one discrete helically configured crimped portion, or a combination thereof.

6. The SMF of claim 1, wherein the SMF comprises a sheath/core configuration, a side-by-side configuration, a pie configuration, an islands-in-the-sea configuration, a multilobed configuration, or any combinations thereof.

7. The SMF of claim 6, wherein the sheath/core configuration comprises an eccentric sheath/core configuration including a sheath component and core component; wherein the core component defines at least a portion of an outer surface of the SMF having the eccentric sheath/core configuration.

8. The SMF of claim 1, wherein the polyolefin fraction A accounts for more than 50% by weight of the first polymeric material.

9. The SMF of claim 1, wherein the polyolefin fraction B comprises from 0.5% by weight to 10% by weight of the first polyolefin composition.

10. The SMF of claim 1, wherein the first polymeric material has a polydispersity value from 3 to 10.

11. The SMF of claim 1, wherein the second polymeric material comprises a second MFR from 20 to 48 g/10 min; and wherein the SMF comprises a side-by-side configuration having a round cross-section.

12. The SMF of claim 1, wherein the first polypropylene has a lower degree of crystallinity than the second polypropylene and/or the polyethylene.

13. A nonwoven fabric, comprising:

a first disposable-high-loft ("DHL") nonwoven layer comprising the plurality of self-crimped multi-component fiber (SMFs); wherein the first DHL nonwoven layer has a cross-direction, a machine direction, and a z-direction thickness;

the plurality of SMFs comprise (i) a first component comprising a first polymeric material, wherein the first polymeric material comprises a first melt flow rate (MFR) less than 50 g/10 min, the first polymeric material is formed from a blend of a first polyolefin fraction A consisting of a first polypropylene and having a melt flow rate-A (MFR-A) and a polyolefin fraction B consisting of a second polypropylene and having a melt flow rate-B (MFR-B); wherein the first polymeric material comprises from 0.5 to 12% by weight of the second polypropylene and a MFR-ratio between MFR-B and MFR-A is from 15:1 to 100:1; and (ii) a second component comprising a second polymeric material, wherein the second component is formed from a polyethylene; and wherein the SMFs comprises one or more three-dimensional crimped portions;

the first DHL nonwoven layer has (a) the z-direction thickness from 0.3 to 3 mm, (b) a first bulk density from 10 kg/m$^3$ to 70 kg/m$^3$, or both (a) and (b).

14. The nonwoven fabric of claim 13, wherein the first DHL nonwoven layer comprises a first bonded area defined by a first plurality of discrete first bond sites, the first plurality of first discrete bond sites has an average distance between adjacent first bond sites from 1 mm to 10 mm, and the SMFs comprise one or more crimped portions located between adjacent first bond sites.

15. The nonwoven fabric of claim 13, further comprising a second nonwoven layer being bonded directly or indirectly to the first DHL nonwoven layer, wherein the second nonwoven layer has a second bulk density, wherein the second bulk density is larger than the first bulk density of the first DHL nonwoven layer.

16. The nonwoven fabric of claim 15, wherein the second nonwoven layer comprises one or more spunbond layers, one or more meltblown layers, one or more carded nonwoven layers, one or more mechanically bonded nonwoven layers, or any combination thereof.

17. The SMF of claim 1, wherein the polyolefin fraction B comprises a meltblown polypropylene resin.

18. The SMF of claim 1, wherein the second polymeric material consists of the polyethylene that is provided in neat form.

19. The SMF of claim 1, wherein the second polymeric material comprises a second MFR that is less than 50 g/10 min.

* * * * *